US012721430B1

(12) United States Patent
Pu et al.

(10) Patent No.: US 12,721,430 B1
(45) Date of Patent: Sep. 1, 2026

(54) STORAGE BOX WITH DRAWER

(71) Applicant: JUSTROOMY LLC, Tracy, CA (US)

(72) Inventors: Yubin Pu, Tracy, CA (US); Changsong Zhu, Shenzhen City (CN)

(73) Assignee: JUSTROOMY LLC, Tracy, CA (US)

( * ) Notice: Subject to any disclaimer, the term of this patent is extended or adjusted under 35 U.S.C. 154(b) by 0 days.

(21) Appl. No.: 19/455,842

(22) Filed: Jan. 22, 2026

(51) Int. Cl.

| | |
|---|---|
| ***A47B 47/00*** | (2006.01) |
| ***A47B 47/04*** | (2006.01) |
| ***A47B 87/02*** | (2006.01) |
| ***A47B 88/90*** | (2017.01) |
| ***A47B 96/20*** | (2006.01) |

(52) U.S. Cl.
CPC ..... *A47B 47/0075* (2013.01); *A47B 47/0091* (2013.01); *A47B 47/042* (2013.01); *A47B 47/047* (2013.01); *A47B 87/0276* (2013.01); *A47B 87/0292* (2013.01); *A47B 88/90* (2017.01); *A47B 96/201* (2013.01); *A47B 2210/19* (2013.01)

(58) Field of Classification Search
CPC ..... A47B 47/0066; A47B 47/0075; A47B 47/0091; A47B 47/04; A47B 47/042; A47B 47/047; A47B 87/0276; A47B 87/0284; A47B 87/0292; A47B 88/90; A47B 88/906; A47B 88/0003; A47B 2210/01; A47B 2210/03; A47B 2210/19; A47B 96/201
See application file for complete search history.

(56) References Cited

U.S. PATENT DOCUMENTS

| | | | | |
|---|---|---|---|---|
| 3,796,474 A * | 3/1974 | Noneman | A47B 88/906 312/334.44 |
| 3,848,942 A * | 11/1974 | Fanini | A47B 87/02 312/265.5 |
| 4,988,003 A * | 1/1991 | Spitzer | A47B 87/0207 220/23.6 |
| 5,913,580 A * | 6/1999 | Liu | F16B 12/26 312/263 |
| 6,988,780 B2 * | 1/2006 | Anderson | A47B 47/042 312/257.1 |
| 9,095,212 B2 * | 8/2015 | Yamamoto | A47B 87/0276 |

(Continued)

FOREIGN PATENT DOCUMENTS

| | | | |
|---|---|---|---|
| CN | 117137261 A * | 12/2023 | A47B 47/05 |
| EP | 4176768 A1 * | 5/2023 | A47B 47/047 |

(Continued)

*Primary Examiner* — Andrew Roersma
(74) *Attorney, Agent, or Firm* — Li & Cai Intellectual Property Office

(57) ABSTRACT

A storage box with a drawer includes a frame and the drawer slidably disposed within the frame. A bottom of the frame has a joining portion, and a top of the frame has a joined portion, such that the storage boxes can be used individually or stacked. Connecting grooves of brackets for connecting top and bottom plates are provided on opposite sides of the two brackets. Lateral sides of the drawer are tilted downward and inward. Corner portions of the drawers have outward lateral recesses, and supporting eaves are provided on the outside of the corner portions. The lateral recess has a rib. When multiple drawers are nested, the supporting eaves have a supporting fit with edges of an opening of the adjacent drawer, and the ribs have an abutment fit with outer walls of the lateral recesses of the adjacent drawer.

14 Claims, 21 Drawing Sheets

(56) References Cited

U.S. PATENT DOCUMENTS

| | | | | |
|---|---|---|---|---|
| 11,203,466 | B2 * | 12/2021 | Kobayashi | B65D 21/0222 |
| 11,350,744 | B2 * | 6/2022 | Kobayashi | A47B 87/0292 |
| 11,388,995 | B1 * | 7/2022 | Le | A47B 88/402 |
| 12,059,071 | B2 * | 8/2024 | Kobayashi | A47B 67/04 |
| 2005/0168115 | A1 * | 8/2005 | Moon | A47B 88/437 312/257.1 |
| 2006/0152114 | A1 * | 7/2006 | Yamada | A47B 87/02 312/107 |
| 2006/0250052 | A1 * | 11/2006 | Davis | F16B 12/26 312/107 |
| 2007/0080614 | A1 * | 4/2007 | Stein | A47B 47/042 312/107 |
| 2010/0253196 | A1 * | 10/2010 | Nye | A47B 47/042 312/352 |
| 2011/0079565 | A1 * | 4/2011 | Alli | A47B 57/10 211/36 |
| 2011/0304249 | A1 * | 12/2011 | Lai | A47B 88/9418 312/265.5 |
| 2014/0300260 | A1 * | 10/2014 | Sofy | B62B 3/003 312/249.11 |
| 2019/0276184 | A1 * | 9/2019 | Kobayashi | B65D 43/0202 |

FOREIGN PATENT DOCUMENTS

| | | | | | |
|---|---|---|---|---|---|
| GB | 2318501 | A | * | 4/1998 | A47B 47/00 |
| JP | 3182614 | U | * | 4/2013 | |
| JP | 6263521 | B2 | * | 1/2018 | |
| JP | 3224317 | U | * | 12/2019 | A47B 87/005 |
| JP | 2021029841 | A | * | 3/2021 | A47B 67/04 |
| JP | 2021040740 | A | * | 3/2021 | |
| KR | 200321921 | Y1 | * | 7/2003 | A47B 7/007 |
| KR | 2020110010225 | U | * | 10/2011 | A47B 88/40 |
| KR | 1020230159170 | A | * | 11/2023 | A47B 7/0276 |

* cited by examiner

STORAGE BOX WITH DRAWER

FIELD OF THE DISCLOSURE

The present disclosure relates to a storage box with a drawer, and more particularly to a storage box with a drawer that can be stacked for use.

BACKGROUND OF THE DISCLOSURE

A storage box with a drawer is a container for storing items and is common in daily life.

Existing storage boxes with the drawer have the following defects: such storage boxes are usually composed of multiple drawers slidably arranged in a large frame, a structure of the storage boxes cannot be flexibly adjusted to meet the diverse needs of users, and the storage boxes are inconvenient for storage and transport.

SUMMARY OF THE DISCLOSURE

A first aspect of the present disclosure provides a storage box with a drawer. The storage box can be used individually or in a stack, the storage box is convenient for storage and transportation, and a frame is not easily disassembled when the storage box is lifted upward.

A second aspect of the present disclosure provides a storage box with a drawer, and the storage box can be used individually or in stacks. The drawers can be stably nested during storage and transportation, and the nesting can be easily detached without scratching the drawer surface over a large area.

Based on the first aspect of the present disclosure, a storage box with a drawer is provided, including:

a frame; and the drawer slidably disposed within the frame;

a bottom of the frame has a joining portion, a top of the frame has a joined portion, and the frame includes:

a first bracket and a second bracket opposite to each other; and a top plate and a bottom plate detachably disposed between the first bracket and the second bracket;

each of opposite sides of the first bracket and the second bracket has a connecting groove, and a side of the connecting groove has a clamping hole; each of an end portion of the top plate and an end portion of the bottom plate has a tongue plate, and a side of each of the tongue plates has an engaging block; and the tongue plate is inserted into the connecting groove, and the engaging block is engaged to the clamping hole.

In the present embodiment, the bottom of the frame of the storage box has the joining portion, and the top of the frame of the storage box has the jointed portion. When two or more storage boxes are stacked, the joining portion and the joined portion cooperate to form a combined storage box of corresponding size. That is, a single storage box can be used independently, or a corresponding number of storage boxes can be purchased and stacked to form a combined storage box of corresponding size, thereby meeting the needs of different users. Furthermore, the frame of the storage box includes the first bracket, the second bracket, the top plate, and the bottom plate, which are detachably assembled. During storage and transportation, the frame can be disassembled into multiple components to be stored in drawers or other smaller spaces, thereby reducing space usage and facilitating storage and transportation. Furthermore, the connecting grooves are formed on opposite sides of the first bracket and the second bracket, and tongue plates are disposed at the end portions of the top plate and the bottom plate. The tongue plates are inserted into the connecting grooves in a direction substantially perpendicular to a direction of gravity and are locked by the engaging block and the clamping hole. This ensures that when the storage box is lifted upward, the top plate will not disengage from the brackets due to the weight of the storage box and the items inside the storage box, thereby reducing the possibility of the frame disintegrating.

In certain embodiments, each of the first bracket and the second bracket are quadrilateral brackets, the quadrilateral bracket includes a horizontal beam and a vertical beam, and the connecting groove is arranged on the horizontal beam. In this way, the weight of the frame can be reduced and material cost can be saved.

In certain embodiments, multiple connecting grooves are provided, each of the connecting grooves is arranged at intervals along a horizontal direction of the horizontal beam, and the tongue plates correspond to the connecting grooves, respectively. In this way, the partitions between adjacent connecting grooves support the two sidewalls of the connecting grooves, thereby ensuring the strength of the horizontal beam itself.

In certain embodiments, end portions of the top plate and the bottom plate respectively have mounting positioning portions, and the vertical beam has positioning matching portions corresponding to the mounting positioning portions, and during installation, the mounting positioning portions enter the positioning matching portions earlier than the tongue plates enter the connecting grooves. This addresses the issue of difficult mounting alignment when there are a large number of connecting grooves and tongue plates, and improves the convenience of frame assembly.

In certain embodiments, the joining portion has a plug-in portion provided on a bottom of the vertical beam, and an enclosure plate provided on a bottom of the bottom plate; and the joined portion has a plug-in fitting portion provided on a top of the vertical beam, and a positioning cavity provided on a top of the top plate and corresponding to the enclosure plate. The plug-in portion engages with and positions the plug-in fitting portion, and the enclosure plate engages with and positions the positioning cavity, creating a double-layered engagement positioning, which provides greater reliability than a single-layered engagement positioning. The plug-in portion and the plug-in fitting portion also play a primary load-bearing role, and arranging them on the vertical beam provides a better load-bearing effect than arranging them on the horizontal beam.

In certain embodiments, the bottom plate has a hollow hole; the joining portion further includes a friction plate that extends downward from an edge of the hollow hole; and the friction plate is configured so that when multiple storage boxes are stacked, the friction plate frictionally engages with the top of the top plate of an adjacent one of the multiple storage boxes. Therefore, when a storage box is subjected to a horizontal external force, friction is generated between the friction plate and the top of the top plate of the adjacent one of the multiple storage boxes, thereby forming a triple-layered engagement positioning and improving the reliability of the stacked storage boxes.

Based on the second aspect of the present disclosure, a storage box with a drawer is provided, including:

a frame; and the drawer slidably disposed within the frame;

a bottom of the frame has a joining portion, a top of the frame has a joined portion, and the frame includes:

a first bracket and a second bracket opposite to each other; and a top plate and a bottom plate detachably disposed between the first bracket and the second bracket;

lateral sides of the drawer being inclined downward and inward; and the drawer having four corner portions, each of the corner portions has a lateral recess facing outward, the lateral recess has a supporting eave arranged on an outer side of the corner portions, and the lateral recess has a rib that extends vertically;

the supporting eaves are configured so that: when multiple drawers are nested, the supporting eaves have a supporting fit with edges of and opening of an adjacent one of the multiple drawers to provide support for the multiple drawers in a direction of gravity;

the ribs are configured so that: when the multiple drawers are nested, the ribs have an abutment fit with outer walls of the lateral recesses of the adjacent one of the multiple drawers to provide support for the adjacent one of the multiple drawers in a horizontal direction, and a gap is provided between adjacent walls of the adjacent multiple drawers to avoid friction between the adjacent walls.

In the present embodiment, the bottom of the frame of the storage box has the joining portion, and the top of the frame of the storage box has the jointed portion. When two or more storage boxes are stacked, the joining portion and the jointed portion cooperate to form a combined storage box of corresponding size. That is, a single storage box can be used independently, or a corresponding number of storage boxes can be purchased and stacked to form a combined storage box of corresponding size, thereby meeting the needs of different users. Furthermore, the frame of the storage box includes the first bracket, the second bracket, the top plate, and the bottom plate, which can be detachably assembled. During storage and transportation, the frame can be disassembled into multiple components to be stored in drawers or other smaller spaces, thereby reducing space usage and facilitating storage and transportation. Furthermore, the above-mentioned specific structure of the drawers allows the drawers to be nested during storage and transportation, and further reduces the space occupied. In the nested state, there is no friction between walls of the drawers, and the nesting can be detached by simply overcoming the weight of the drawer. This reduces the resistance during detaching and prevents scratching inner walls of the drawer.

In certain embodiments, a distance between the supporting eave and the opening of the drawer is not less than a thickness of the first bracket, and is not less than a thickness of the second bracket. Thus, when the drawers are nested, a space between two adjacent drawers can be used to store either the first bracket or the second bracket, thereby further improving space utilization and facilitating storage and transportation.

In certain embodiments, a minimum length of the drawer is greater than a length of the first bracket, a minimum width of the drawer is greater than a height of the first bracket, and the second bracket is equal in length and height to the first bracket. In this way, when the drawers are nested, the first bracket and the second bracket can be stored in the top drawer, thereby further improving space utilization and facilitating storage and transportation.

In certain embodiments, the rib does not protrude from an inner surface of a corresponding one of the corner portions. In this way, when the drawers are nested or detached, the ribs will not scrape the area outside the lateral recesses on the outer wall of the drawer, thereby better avoiding scratching a surface of the drawer.

In certain embodiments, the joining portion has a plug-in portion provided on a bottom of a vertical beam, and an enclosure plate disposed at a bottom of the bottom plate; and the joined portion has a plug-in fitting portion provided on the bottom of the vertical beam, and a positioning cavity provided on a top of the top plate and corresponding to the enclosure plate. The plug-in portion engages with and positions the plug-in fitting portion, and the enclosure plate engages with and positions the positioning cavity, creating a double-layered engagement positioning, which provides greater reliability than a single-layered engagement positioning. The plug-in portion and the plug-in fitting portion also play a primary load-bearing role, and arranging them on the vertical beam provides a better load-bearing effect than arranging them on the horizontal beam.

In certain embodiments, the bottom plate has a hollow hole; the joining portion further includes a friction plate that extends downward from an edge of the hollow hole; and the friction plate is configured so that when the multiple storage boxes are stacked, the friction plate frictionally engages with the top of the top plate of the adjacent one of the multiple storage boxes. Therefore, when a storage box is subjected to a horizontal external force, friction is generated between the friction plate and the top of the top plate of the adjacent one of the multiple storage boxes, thereby forming a triple-layered engagement positioning and improving the reliability of the stacked storage boxes.

In certain embodiments, each of a lateral side of the first bracket and a lateral side of the second bracket is provided with a recess, and the recess correspondingly passes through the first bracket or the second bracket. A side buckle is installed on an upper part inside of the recess, and a flange is provided on a lower part inside of the recess. Two adjacent ones of the frame are fastened to each other through the flange and the side buckle. Accordingly, when two of the frames are stacked, the side buckle of the lower frame is fastened with the flange of the upper frame. When the drawer that the upper frame belongs to is fully loaded and drawn out to an outermost position, the locking effect of the side buckle prevents the drawer to bring the frame forward and fall. In addition, the recess on the lateral side of the first bracket ensures a certain extent of movement and operation space for a hand performing the action of locking the side buckle.

In certain embodiments, a top of the bottom plate has multiple slide rail grooves, and the multiple slide rail grooves are parallel to each other. Multiple slide bars equal in quantity to the multiple slide rail grooves are disposed on a bottom of the drawer, and the multiple slide bars are embedded in the multiple slide rail grooves. Accordingly, the slide bars are slidable along the slide rail grooves and form a guiding fit with the slide rail grooves, so as to guide a sliding direction of one or more drawers in the frame.

In certain embodiments, multiple rollers are correspondingly disposed on the top of the bottom plate and the bottom of the drawer, the multiple rollers on the bottom plate are each respectively located at one end of each of the multiple slide rail grooves and are in contact with the bottom of the drawer, and the multiple rollers at the bottom of the drawer are in contact with the top of the bottom plate. Accordingly, the slide rail grooves, the slide bars, and the rollers jointly form a slide rail system that limits the drawer to smoothly and freely move in a line along a track of the slide rail groove without ejecting from the frame, and the smooth operation is performed even when the drawer is fully loaded.

In certain embodiments, one end of the top plate has a stop post for limiting the drawer from detaching from the frame, the stop post has an arc-shaped opening, and the arc-shaped opening of the stop post facilitates a smooth installation of the drawer into the frame via an inclined movement. Another end of the top plate has a stop rib for limiting the drawer from detaching from the frame.

In certain embodiments, the top plate has a limiting hole formed to be opposite to the stop post. In a stacked state of multiple ones of the bottom plate and the top plate, the top plate is laid flat on the bottom plate, and the stop post on the top plate is embedded in the limiting hole of another top plate. Accordingly, the top plate and the bottom plate can be stacked. Since the top plate has a protruded structure (the stop post) that prohibits direct stacking, a flipping can be performed for stacking. During stacking, the stop post of the upper top plate is inserted into a hole of the lower top plate, such that after stacking, a packaging volume is reduced and the movement of the components is limited.

In certain embodiments, at least one step post that is outwardly protruding is provided on an upper lateral side of the drawer, and when two of the drawers are stacked, an edge of an upper one of the two drawers is abutted against a lower edge of the step post of a lower one of the two drawers. Accordingly, a gap is ensured to be present between sidewalls of the two stacked drawers. Therefore, when a user unpacks and assembles the drawers, the drawers are easier to be separated and retrieved. Furthermore, a space between bottoms of two adjacent drawers can accommodate the first bracket or the second bracket.

In certain embodiments, the bottom of the bottom plate has multiple universal wheel mounting holes. The forming of the universal wheel mounting holes facilitates the install of the universal wheel at the bottom of the bottom plate, such that the frame can be moved by sliding.

DETAILED DESCRIPTION OF THE EXEMPLARY EMBODIMENTS

The technical solutions in the embodiments of the present disclosure will be further described in detail below in conjunction with the drawings.

Figure 1:
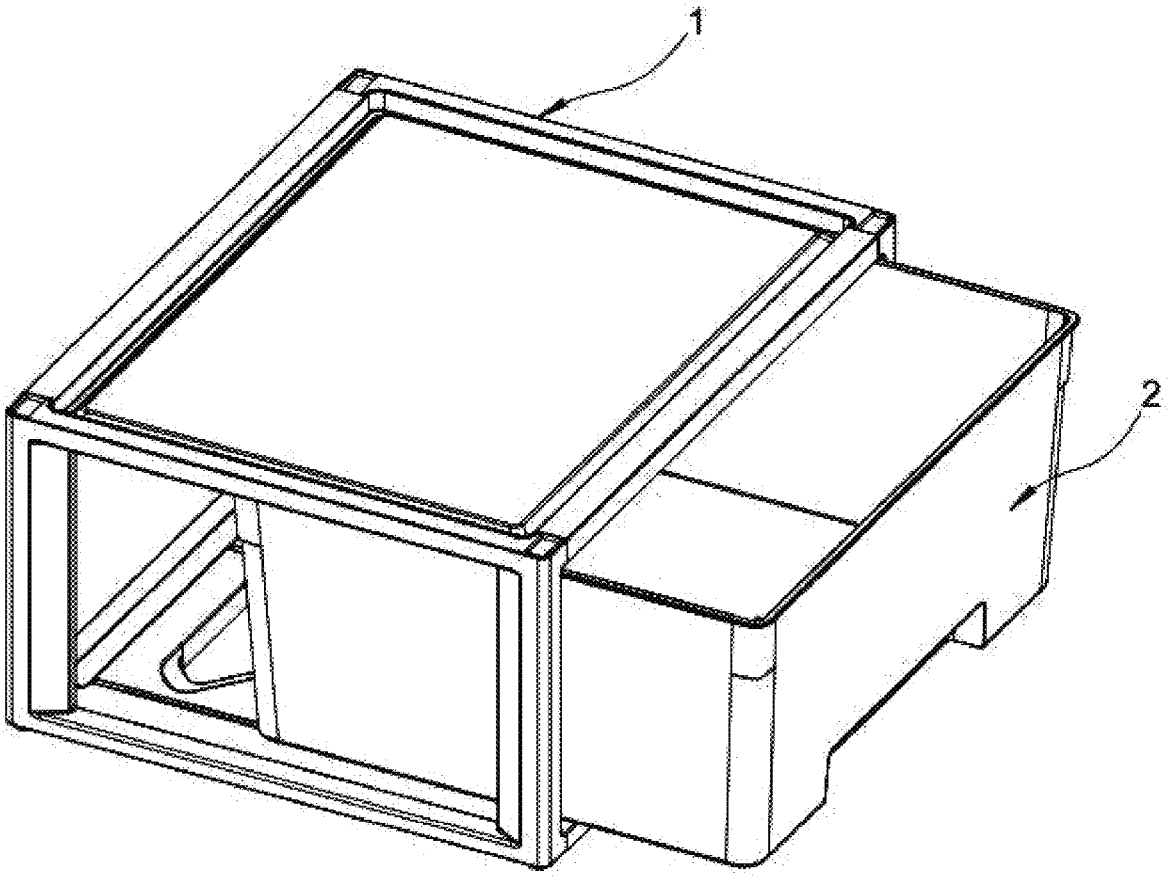
FIG. 1 is a schematic structural diagram of a storage box with a drawer according to certain embodiments.
Figure 2:
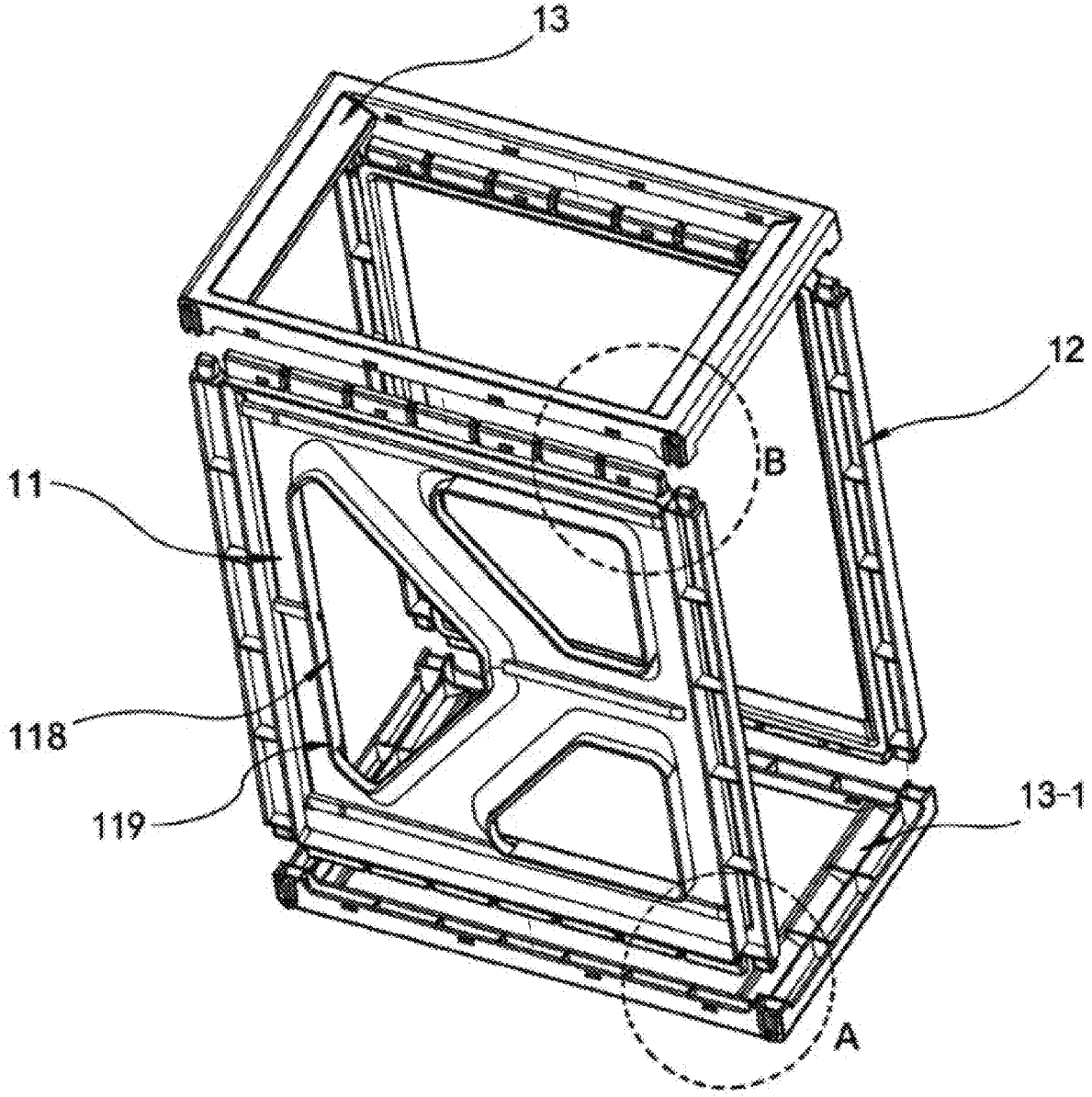
FIG. 2 is an exploded view of a frame of the storage box.
Figure 3:
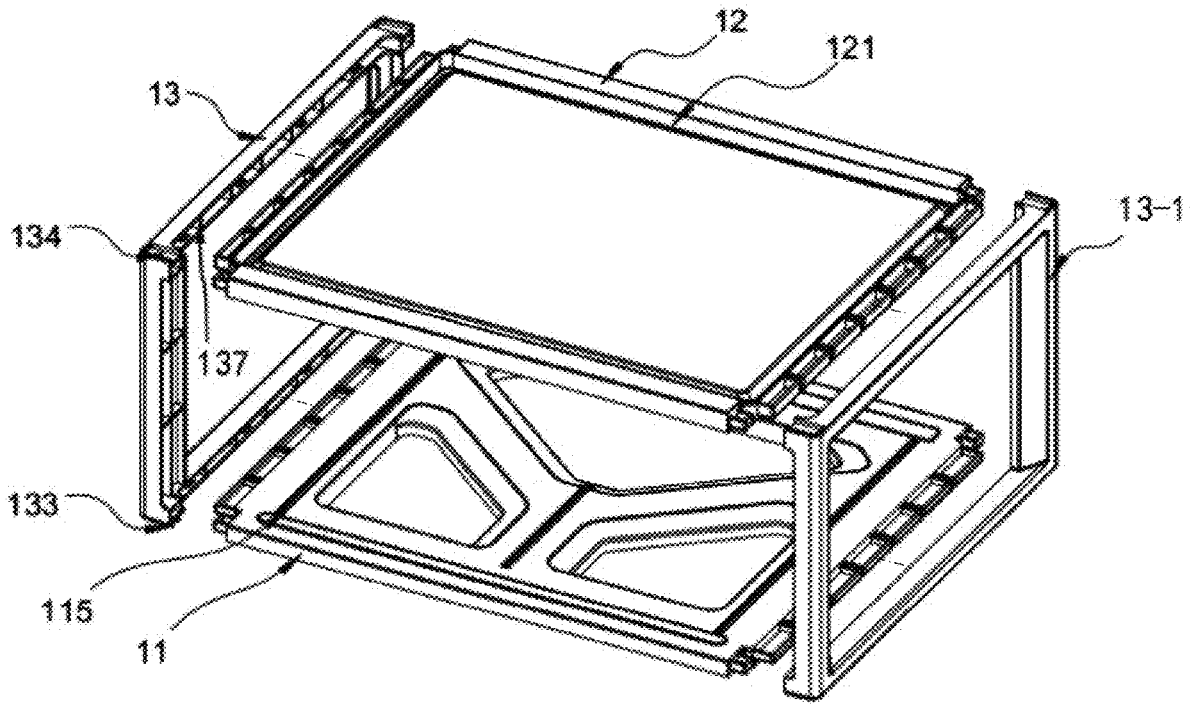
FIG. 3 is another exploded view of the frame of the storage box.
Figure 4:
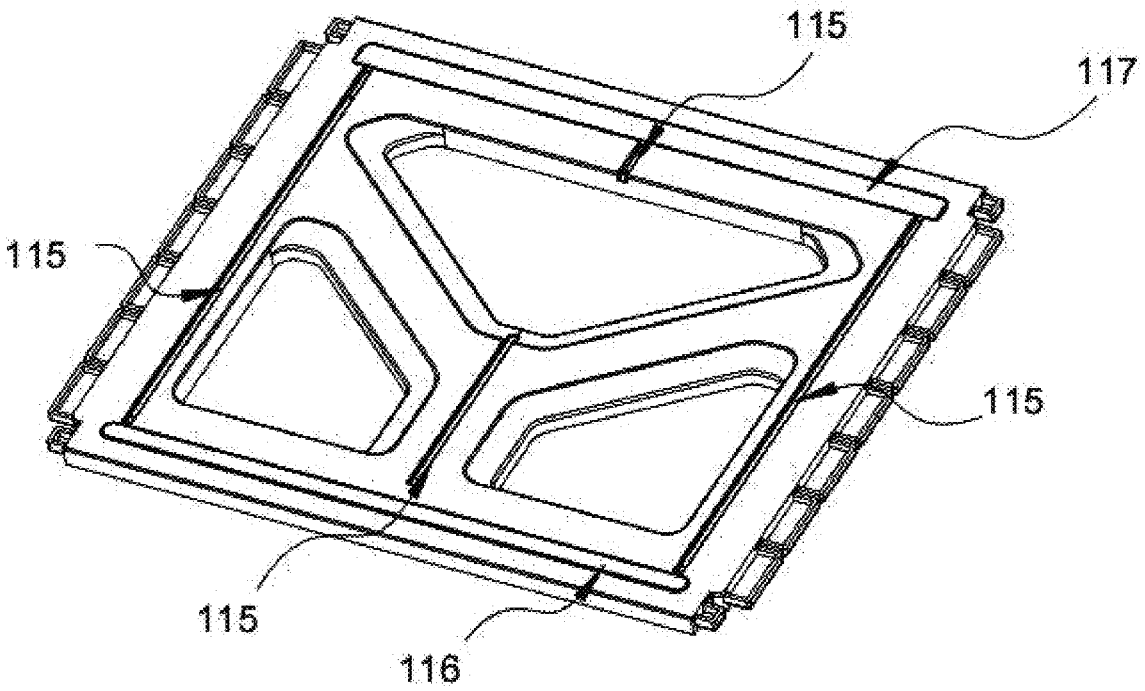
FIG. 4 is a schematic structural diagram of a bottom plate of the frame.
Figure 5:
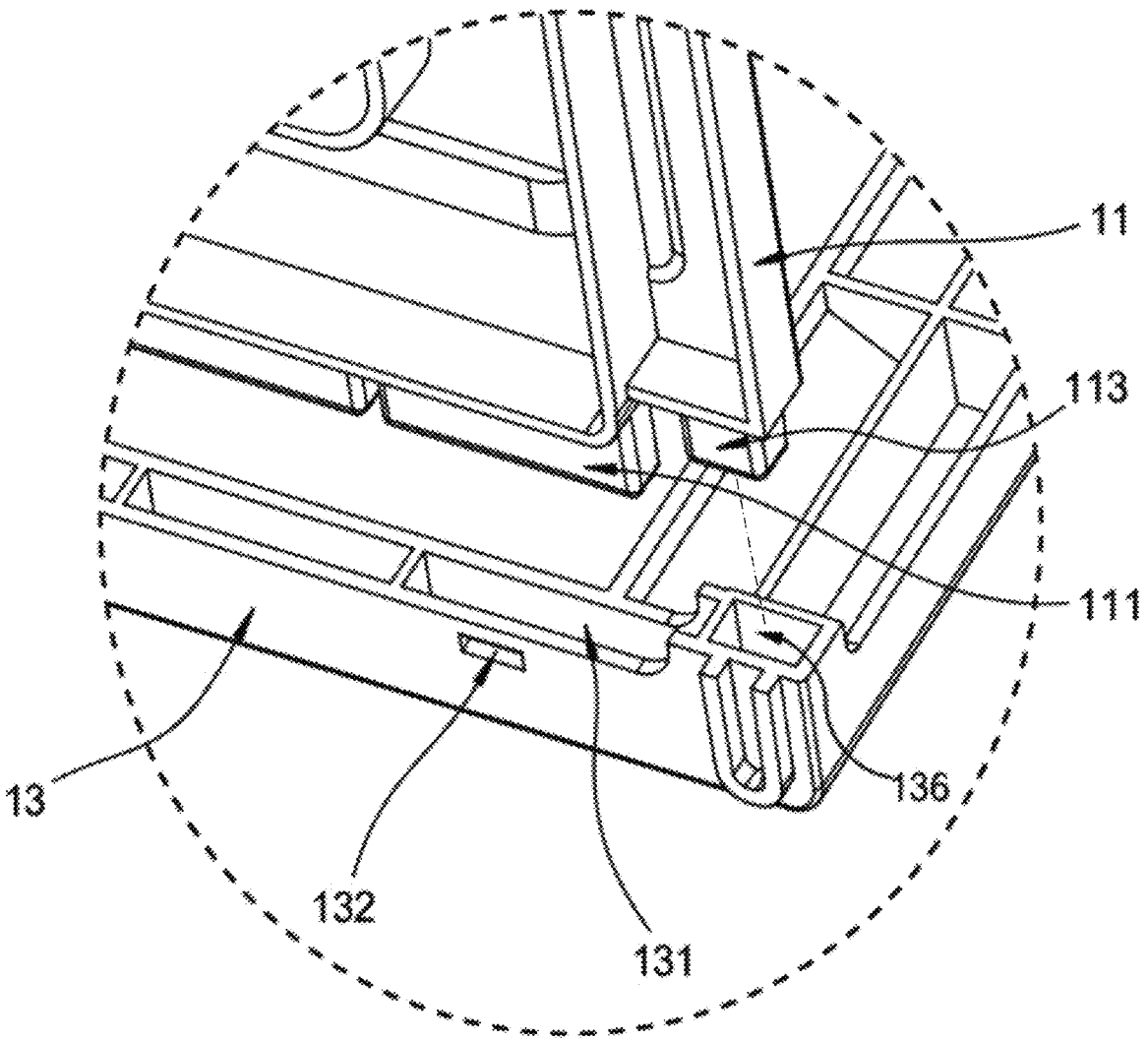
FIG. 5 is an enlarged view of portion A in FIG. 2.
Figure 6:
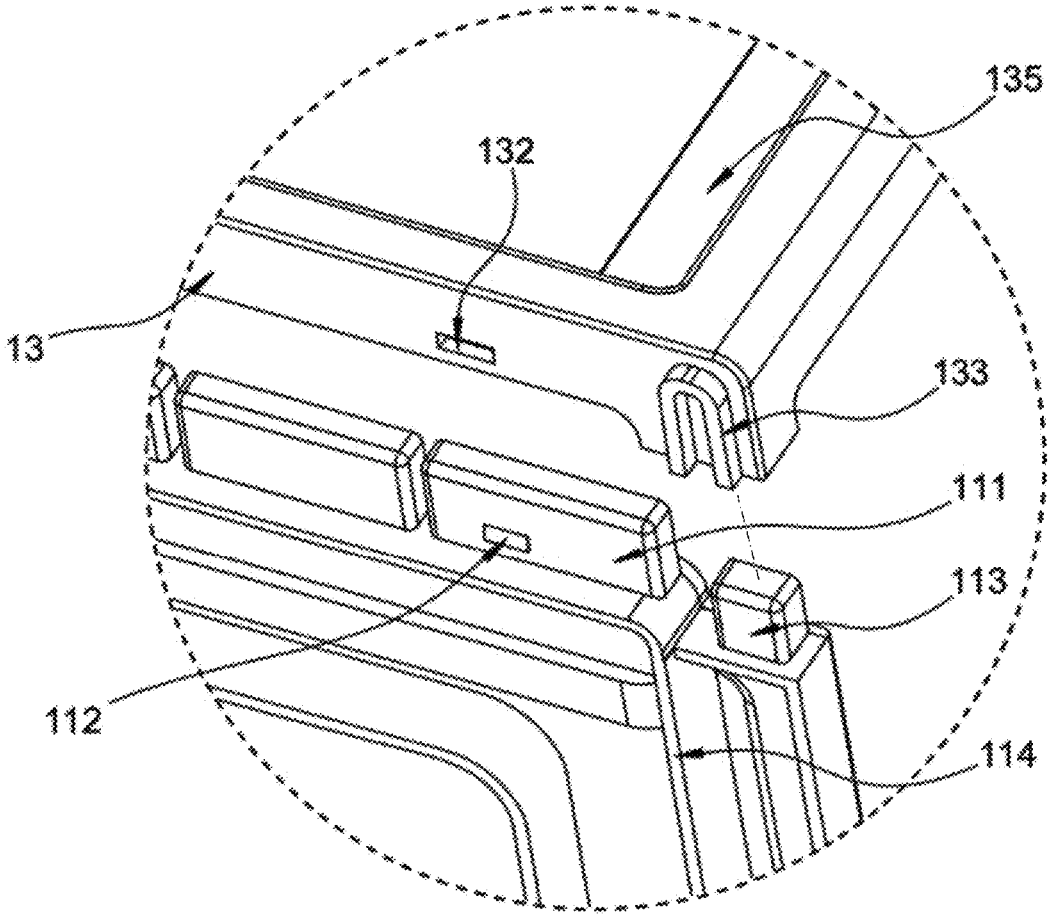
FIG. 6 is an enlarged view of portion B in FIG. 2.
Figure 7:
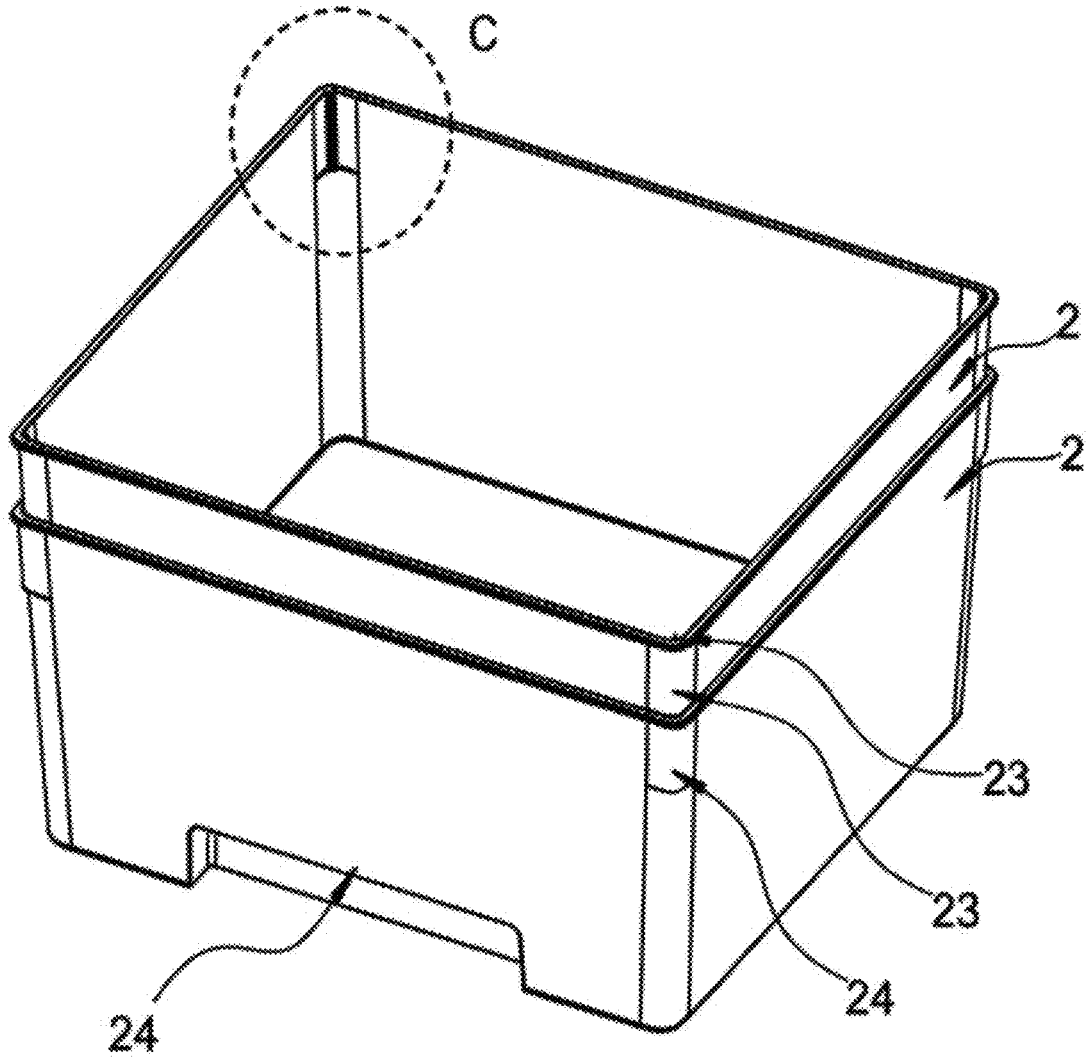
FIG. 7 is a schematic diagram of the drawers in a nesting state.

Referring to FIG. 1, a storage box with a drawer in certain embodiments includes a frame 1 and a drawer 2. The drawer 2 is slidably disposed within the frame 1, and the drawer 2 can be pulled out from the frame 1 for placing items into the drawer 2 or taking items out of the drawer 2.

A joining portion is provided on a bottom of the frame 1, and a joined portion is provided on a top of the frame 1. The joining portion and the joined portion are used in conjunction with each other. Specifically, after stacking two storage boxes, the joining portion at the bottom of the frame 1 of a upper storage box is correspondingly joined with the joined portion at the top of the frame 1 of a lower storage box to join the upper and lower storage boxes together.

Referring to FIG. 2 to FIG. 6, the frame 1 includes a first bracket 13 and a second bracket 13-1 that are opposite to each other in a space 25, and a top plate 12 and a bottom plate 11 that are detachably disposed between the first bracket 13 and the second bracket 13-1. Connecting grooves 131 are defined on opposite sides of the first bracket 13 and the second bracket 13-1, and clamping holes 132 are defined on lateral sides of the connecting grooves 131. Tongue plates 111 are defined at end portions of the top plate 12 and the bottom plate 11, and engaging blocks 112 are defined on lateral sides of the tongue plates 111. The tongue plates 111 are correspondingly inserted into the connecting grooves 131, and the engaging blocks 112 are correspondingly engaged to the clamping holes 132.

A tool is used to push the engaging block 112 out of the clamping hole 132, and then remove the tongue plate 111 from the connecting groove 131. This disassembles the frame 1 into four components: the first bracket 13, the second bracket 13-1, the top plate 12, and the bottom plate 11. The tool can be any tool that can reach into the clamping hole 132, such as a flat-blade screwdriver or tweezers.

The first bracket 13 can be made of a plate, or can be a quadrilateral bracket 13 composed of horizontal beams and vertical beams, but is not limited in the present embodiment.

Similarly, the second bracket 13-1 can be made of a plate or a quadrilateral bracket 13 composed of horizontal beams and vertical beams, but is not limited in this embodiment. Preferably, the structure of the second bracket 13-1 is the same as that of the first bracket 13.

The joining portion and the joined portion are used to stack multiple storage boxes and combine the frames 1 of the storage boxes. The present embodiment does not limit the structure thereof, and the specific structure of the joining portion and the joined portion will be described in detail in the following embodiments.

Figure 14:
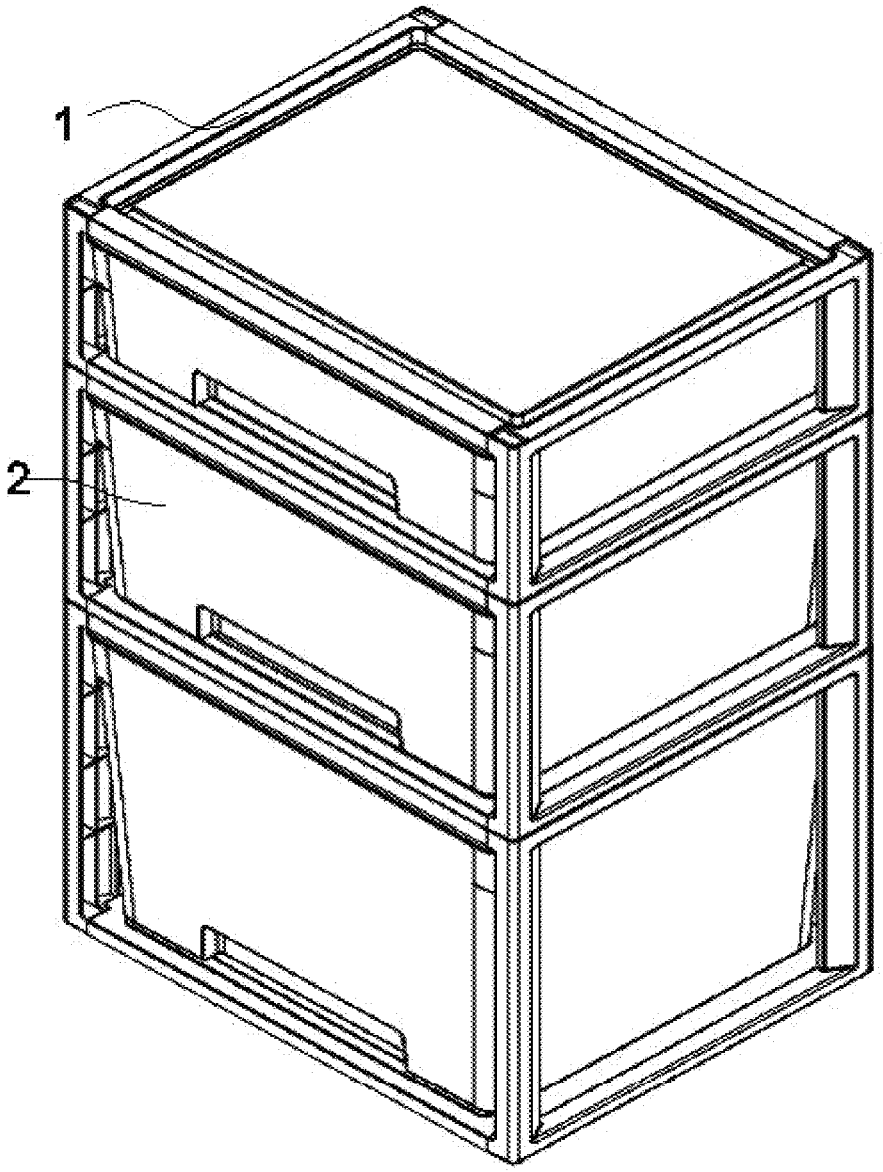
FIG. 14 is a schematic diagram of a plurality of storage boxes stacked.

In the present embodiment, the joining portion is provided on the bottom of the frame 1 of the storage box and the jointed portion is provided on the top of the frame 1 of the storage box. When two or more storage boxes are stacked, the joining portion cooperates with the jointed portion to combine the storage boxes together to form a combined storage box of corresponding size. It can be seen that the storage box of the present embodiment can be used individually, or a corresponding number of storage boxes, such as two, three, four, or more, can be purchased and stacked to form a combined storage box of corresponding size. FIG. 14 shows a combined storage box formed by stacking three storage boxes. The storage boxes of the present embodiment can be flexibly combined. For example, after four storage boxes are purchased, the four storage boxes can be stacked in pairs, or the four storage boxes are stacked together, thus meeting the needs of different users. Moreover, the combination is completed after stacking, thereby making operation simple and convenient.

In the present embodiment, the frame 1 of the storage box includes a detachable combination of the first bracket 13, the second bracket 13-1, the top plate 12, and the bottom plate 11. During storage and transportation, the frame 1 can be disassembled into multiple components, and the components can be accommodated in the drawer 2 or other smaller spaces, thereby reducing the occupied space and facilitating storage and transportation.

In the present embodiment, the connecting grooves 131 are arranged on opposite sides of the first bracket 13 and the second bracket 13-1, and the tongue plates 111 are arranged at the end portions of the top plate 12 and the bottom plate 11. Insertion direction of the tongue plates 111 and the connecting grooves 131 are approximately perpendicular to a direction of gravity and is locked by the engaging blocks 112 and the clamping holes 132. Compared to a connection structure having an insertion direction aligned with a direction of weight, the present embodiment employs a connection structure in which the insertion direction is substantially perpendicular to the direction of gravity. This ensures that when the storage box is lifted upward by grasping the edge of the top plate 12, the top plate 12 will not disengage from the brackets 13 due to the weight of the storage box and its contents. Accordingly, the frame 1 is less likely to disintegrate, thereby improving the reliability of the storage box.

In one embodiment, each of the first bracket 13 and the second bracket 13-1 is a quadrilateral bracket, each of the quadrilateral brackets includes a horizontal beam and a vertical beam, and the connecting groove 131 is provided on the horizontal beam. The quadrilateral bracket can be made of a metal material, such as aluminum, stainless steel, or an alloy, or can be made of a plastic injection molded material. This embodiment does not limit the material of the brackets.

Compared with the bracket made of plate materials, the quadrilateral bracket composed of horizontal beams and vertical beams has the advantages of having a light weight, using less material, and incurring a low cost.

In one example, the horizontal beam of the quadrilateral bracket has multiple connecting grooves 131, each of the connecting grooves 131 is horizontally spaced apart, with the tongue plates 111 corresponding to each of the connecting grooves 131, respectively. Accordingly, the partitions 137 between adjacent connecting grooves 131 support the two sidewalls of the connecting grooves 131, thereby ensuring the strength of the horizontal beam itself.

Preferably, a sum of widths of the connection grooves 131 is as close as possible to a length of the horizontal beam, such that the connection strength between the top plate 12 and the bracket, and the connection strength between the bottom plate 11 and the bracket are improved.

Preferably, a reinforcing plate 135 is disposed on the vertical beam to increase the load-bearing capacity of the storage box.

When there are a large number of connecting grooves 131 and tongue plates 111, if any one of the tongue plates 111 is not aligned with the corresponding connecting groove 131, all of the tongue plates 111 will be unable to be inserted into the corresponding connecting grooves 131, thus causing inconvenience to the assembly of the frame 1.

Accordingly, a mounting positioning portion 113 is further provided at the end portion of the top plate 12, and the mounting positioning portion 113 is further provided at the end portion of the bottom plate 11. The vertical beam has a positioning matching portion 136 corresponding to the mounting positioning portion 113. During installation, the mounting positioning portion 113 enters the positioning matching portion 136 earlier than the tongue plate 111 enters the connecting groove 131. In this way, after the mounting positioning portion 113 enters the positioning matching portion 136, the top plate 12 and the horizontal beam, as well as the bottom plate 11 and the horizontal beam are positioned, such that all the connecting grooves 131 on the horizontal beam are automatically aligned with all of the tongue plates 111 on the top plate 12, and are also automatically aligned with all of the tongue plates 111 on the bottom plate 11. There is no need to align each connecting groove 131 with each tongue plate 111 one by one, thereby improving the convenience of assembling the frame 1.

Specifically, the mounting positioning portion 113 in the present embodiment is a column, which can be a circular cylinder, a polygonal prism, an elliptical cylinder, etc. The positioning matching portion 136 is a hole, which can be a circular hole, a polygonal hole, an elliptical hole, etc. Preferably, a tip is formed at an end portion of the column to guide the column into the hole.

It can be understood that, the mounting positioning portion 113 can also be configured as a hole, and the positioning matching portion 136 can be configured as a column.

The joining portion and the joined portion are used to combine the frames 1 of the storage boxes after two storage boxes are stacked.

In one embodiment, the joining portion has a plug-in portion 133 provided at the bottom of the vertical beam, and an enclosure plate 114 disposed at the bottom of the bottom plate 11; the joined portion has a plug-in fitting portion 134 provided on the top of the vertical beam, and a positioning cavity 121 formed on the top of the top plate 12 and corresponding to the enclosure plate 114.

After the storage boxes are stacked, the plug-in portions 133 and the plug-in fitting portions 134 of the frames 1 of adjacent storage boxes are plugged together, forming a first layer engagement positioning. The enclosure plates 114 on the bottom panels 11 of the adjacent storage boxes are inserted into the positioning cavities 121 at the top of the top panels 12, forming a second layer engagement positioning. Such double-layered engagement positioning improves the reliability of the stacked storage boxes. Furthermore, the first layer engagement positioning is provided between the brackets 13, and the second layer engagement positioning is provided between the top panels 12 and bottom panels 11. These double-layered engagement positionings are provided in different components of the storage boxes, so as to simultaneously provide the positioning effect on different components of the storage boxes.

The plug-in portion 133 and the plug-in fitting portion 134 are also crucial in load-bearing. In the present embodiment, the plug-in portion 133 and the plug-in fitting portion 134 are disposed on the vertical beam to have a more improved load-bearing effect than being disposed on the horizontal beam.

Specifically, the plug-in portion 133 in the present embodiment is a convex portion, and a shape of the convex portion can be a cylinder, a polygonal column, an elliptical column, a U-shaped column, etc. The plug-in fitting portion 134 is a concave portion, and a shape of the concave portion matches the shape of the convex portion. The shape of the concave portion can specifically be a cylindrical concave portion, a polygonal column concave portion, an elliptical column concave portion, a U-shaped column concave portion, etc.

Specifically, a shape of the enclosure plate 114 in the present embodiment is the same as an outline of the bottom plate 11, the positioning cavity 121 on the top of the top plate 12 corresponds in position and is equal in size with the enclosure plate 114, and the positioning cavity 121 is specifically annular.

Compared with the single-layered engagement positioning, the present embodiment adopts the double-layered engagement positioning, which improves the reliability of the stacked storage boxes to a certain extent. However, in certain cases, such as undergoing external force collision, when the engagement positioning is damaged, the stacked storage boxes will be misaligned.

Accordingly, the joining portion at the bottom of the frame 1 further includes a friction plate 119. When the storage boxes are stacked, the friction plate 119 frictionally engages with the top of the top plate 12 in adjacent storage boxes, thereby forming a triple-layered engagement positioning. When the storage boxes sustain horizontal external forces, friction between the friction plates 119 and the top of the top plate 12 of the adjacent storage boxes prevents the stacked storage boxes from misaligning, thereby improving the reliability of the stacked storage boxes.

Preferably, the bottom plate 11 of the frame 1 has at least one hollow hole 118, an edge of the one hollow hole 118 extends downward to form the friction plate 119. In a preferred embodiment, the hollow hole 118 in the bottom plate 11 can reduce the weight of the frame 1 and save raw materials. Moreover, the friction plate 119 that is formed has an annular structure. Compared with the friction plate 119 that is flat, the annular friction plate 119 can generate friction in multiple directions on the top of the top plate 12, thereby preventing the stacked storage boxes from misaligning in multiple directions.

Referring to FIG. 7 to FIG. 13, in order to further reduce the space occupied during storage and transportation, the drawers 2 are further configured such that lateral sides of the drawers 2 are tilted downward and inward. In this way, the drawers 2 can be nested together, achieving the effect of reducing the space occupied during storage and transportation.

It can be understood that the drawer 2 generally has four corner portions, where the corner portions refer to the connecting parts of adjacent side parts.

When the drawers 2 are nested together, a friction force is generated between walls of adjacent drawers 2, and the drawers 2 can be detached from their nesting only after overcoming the friction force. Furthermore, the friction force may cause scratches on the surface of the drawers 2.

Accordingly, in certain embodiments, each of the corner portions of the drawer 2 has a lateral recess 22 facing outward, the lateral recess 22 has a supporting eave 26 arranged on an outer side of the corner portions of the drawer 2, and the lateral recess 22 has a rib 23 that extends vertically.

The supporting eaves 26 are configured such that when multiple drawers 2 are nested, the supporting eaves 26 have a supporting fit with edges of openings of the multiple drawers 2 to provide support to the drawers 2 in the direction of gravity.

Here, the ribs 23 are configured such that when multiple drawers 2 are nested, the ribs 23 have an abutment fit with outer walls of the lateral recesses 22 of the adjacent drawer 2 to provide support for the adjacent drawer 2 in a horizontal direction, so that a gap is provided between adjacent walls of the adjacent multiple drawers 2 to avoid friction between the adjacent walls.

In the present embodiment, when the drawers 2 are nested, they are mainly supported by the supporting eaves 26. There is no friction between the walls of two adjacent drawers 2. The nesting can be detached by overcoming the weight of the drawers 2, and inner walls of the drawers 2 will not be scratched.

In a further embodiment, the supporting eaves 26 are further configured such that a distance between the supporting eave 26 and the opening of the drawer 2 is not less than a thickness of the first bracket 13 and not less than a thickness of the second bracket 13-1.

This ensures that in the nested state, the space 25 between the bottoms of two adjacent drawers 2 is sufficient to accommodate the first bracket 13 or the second bracket 13-1. During storage or transportation, the first bracket 13 or the second bracket 13-1 can be stored in the space 25 (as shown in FIG. 10), further improving space utilization.

In a further embodiment, the drawer 2 is further configured such that a minimum length of the drawer 2 is greater than a length of the first bracket 13, and a minimum width of the drawer 2 is greater than a height of the first bracket 13. Furthermore, the second bracket 13-1 is equal in length and height to the first bracket 13. This allows a topmost drawer 2 to accommodate both the first bracket 13 and the second bracket 13-1 in the nested state.

Figure 8:
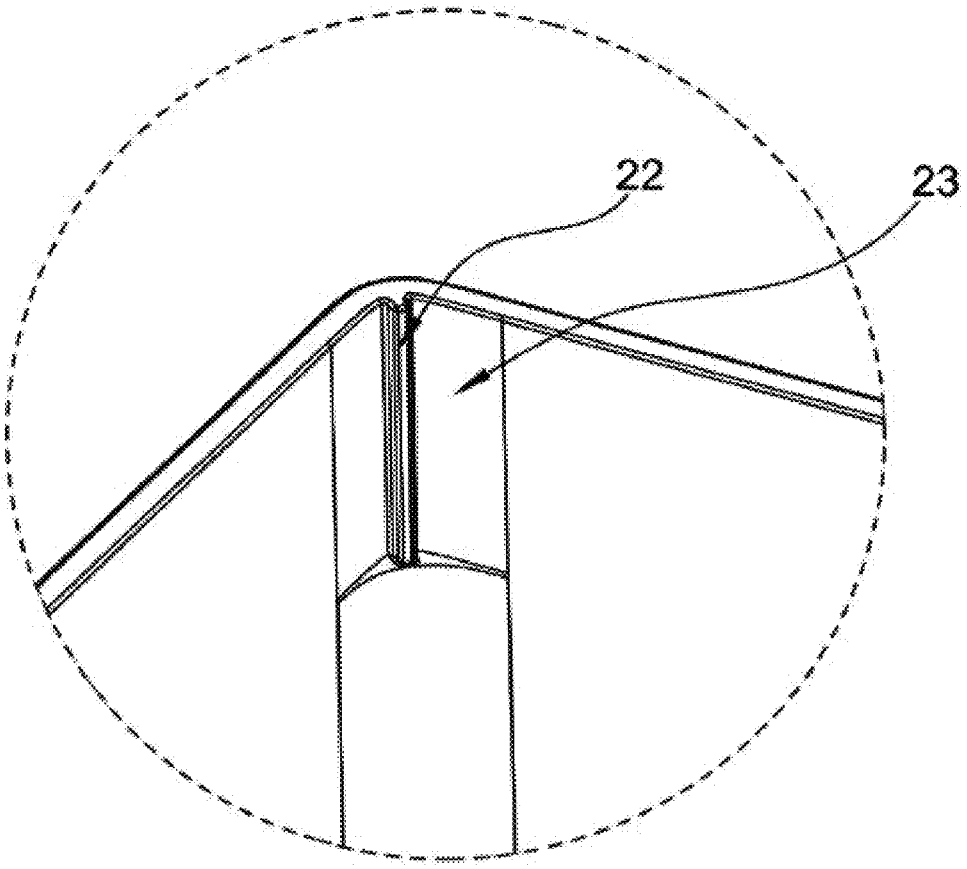
FIG. 8 is an enlarged view of portion C in FIG. 7.
Figure 9:
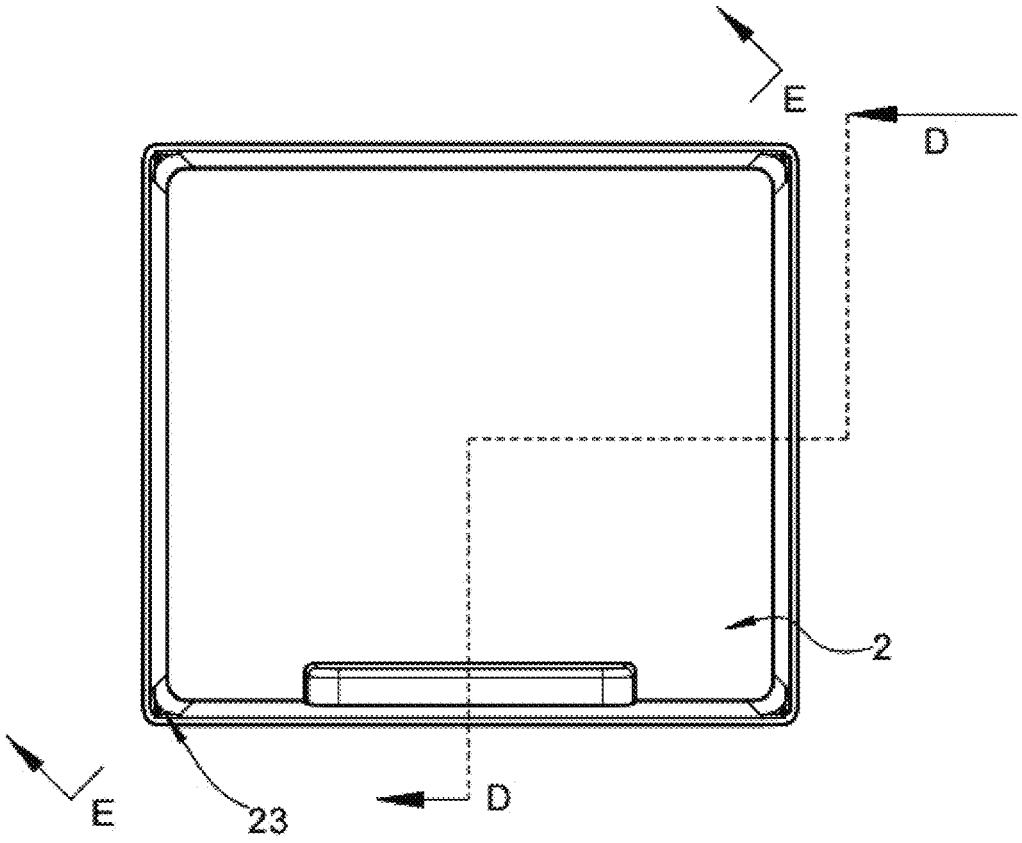
FIG. 9 is a schematic top view of the drawer.

In a further embodiment, the ribs 23 are configured such that the ribs 23 do not protrude from the inner surface of the corner portions, as shown in FIG. 8. This ensures that during the operations of nesting and detaching the nesting of the drawers 2, the ribs 23 only contact the outer walls of the lateral recesses 22 and do not contact or scratch other areas of the outer wall of the drawer 2.

Figure 10:
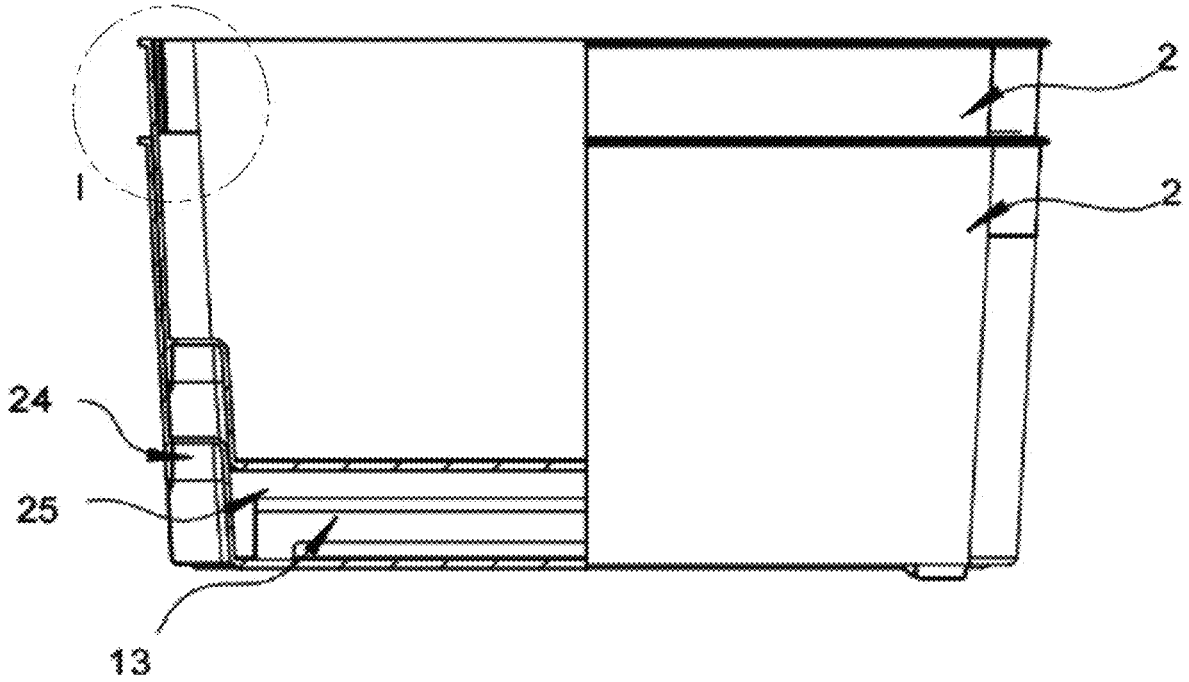
FIG. 10 is a cross-sectional view taken along line D-D of FIG. 9.
Figure 11:
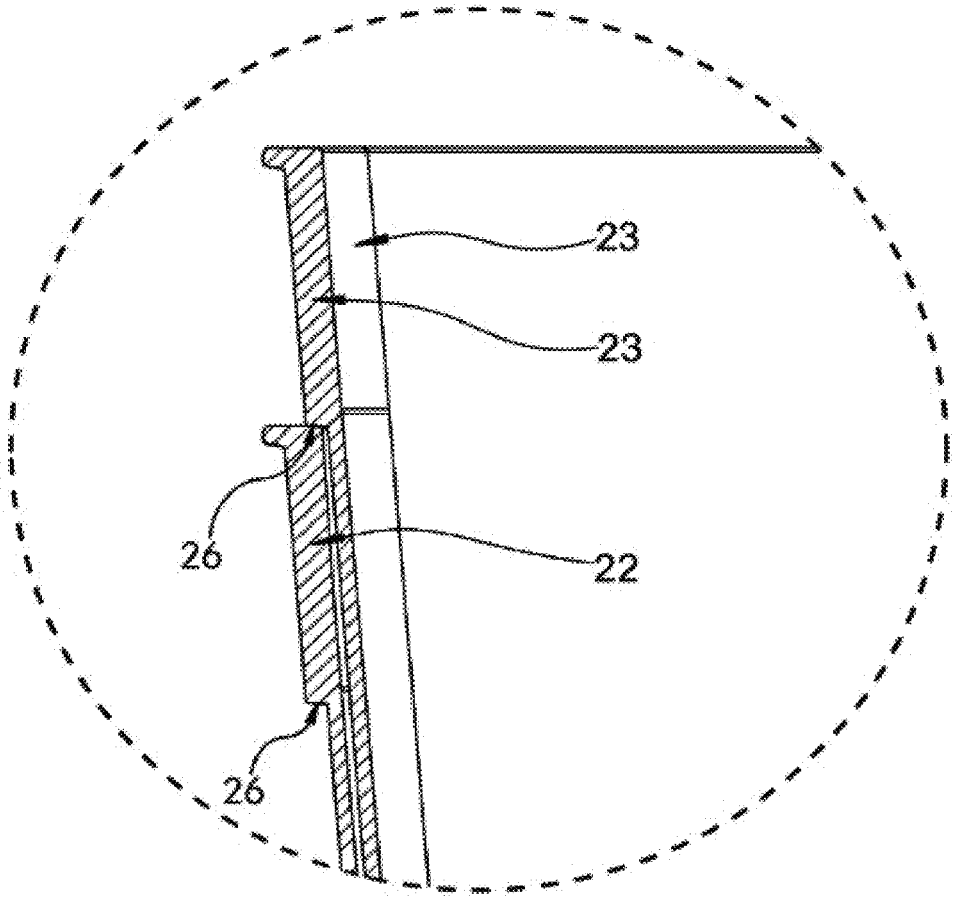
FIG. 11 is a cross-sectional view taken along line E-E of FIG. 9.
Figure 12:
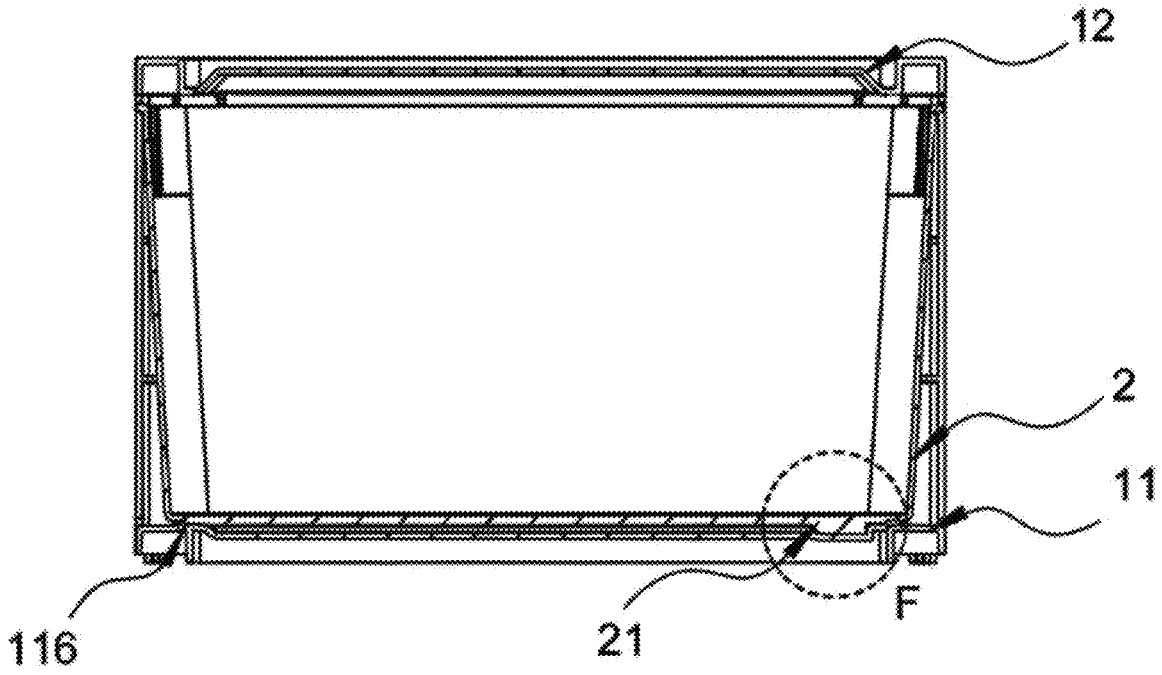
FIG. 12 is a schematic cross-sectional view of the storage box according to certain embodiments.
Figure 13:
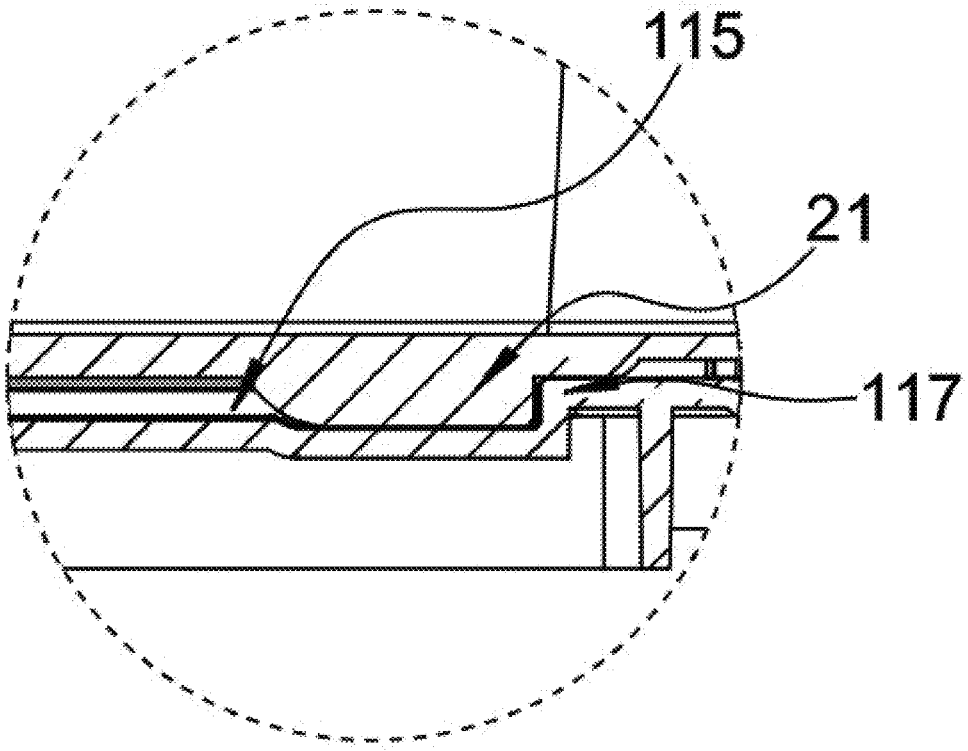
FIG. 13 is an enlarged view of portion F in FIG. 12.
Figure 15:
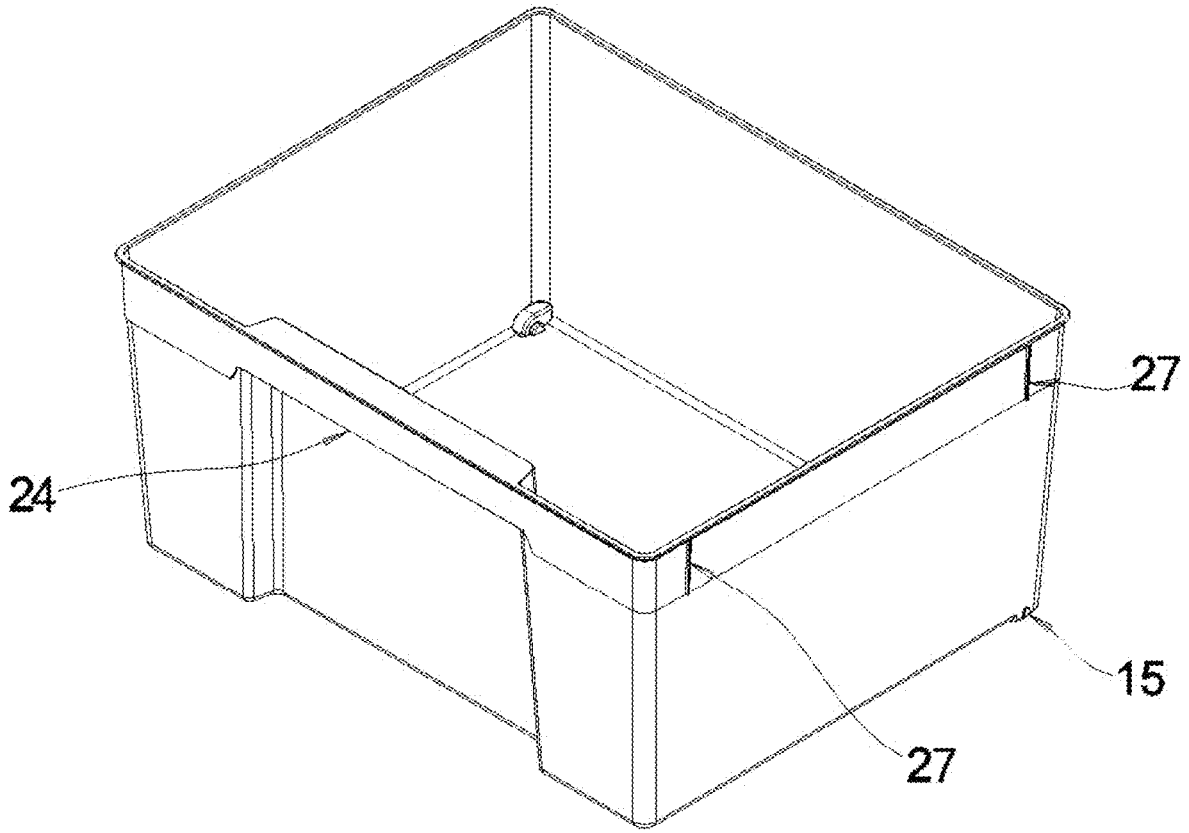
FIG. 15 is a schematic perspective diagram of the drawer having stepped posts.
Figure 16:
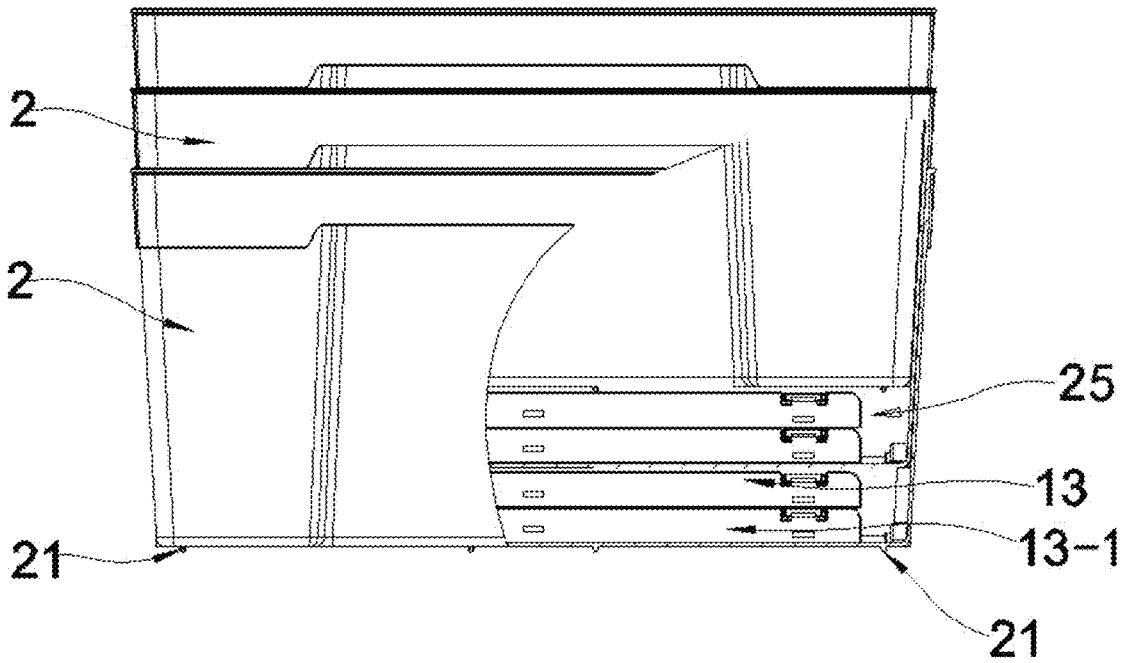
FIG. 16 is another schematic diagram of multiple storage boxes stacked.

Referring to FIG. 10, FIG. 15, and FIG. 16, a handle 24 is disposed on a lateral side of the drawer 2. The handle 24 is used to drag the drawer 2 to slide, to pull the drawer 2 out of the frame 1, or to push the drawer 2 back into the frame 1. Multiple ones of the drawer 2 can be stacked. Each of the drawers 2 has at least one outwardly protruding step post 27 formed on an upper side thereof. When two drawers 2 are stacked, an edge of the upper drawer 2 is abutted against a lower edge of the step post 27 of the lower drawer 2. This ensures that a gap is present between sidewalls of the two stacked drawers 2, making it easy for the user to separate and retrieve the drawers 2 during unpacking and assembly. A space 25 between the bottoms of two adjacent drawers 2 is sufficient to accommodate the first bracket 13 or the second bracket 13-1.

Referring to FIG. 4, FIG. 12, FIG. 13, and FIG. 17, multiple slide rail grooves 115 are provided on the top of the bottom plate 11 of the frame 1. Specifically, each of the slide rail grooves 115 is formed by two protruding ribs. A quantity of the slide rail grooves 115 is three, four, five, or six, and can be flexibly disposed according to the quantity of the drawers 2. The slide rail grooves 115 are parallel to each other. Multiple slide bars 21 equal in quantity to the multiple slide rail grooves 115 are disposed on a bottom of the drawer 2, and the multiple slide bars 21 are embedded in the multiple slide rail grooves 115. Accordingly, the slide bars 21 are slidable along the slide rail grooves 115 and form a guiding fit with the slide rail grooves 115, so as to guide a sliding direction of one or more drawers 2 in the frame 1.

Figure 17:
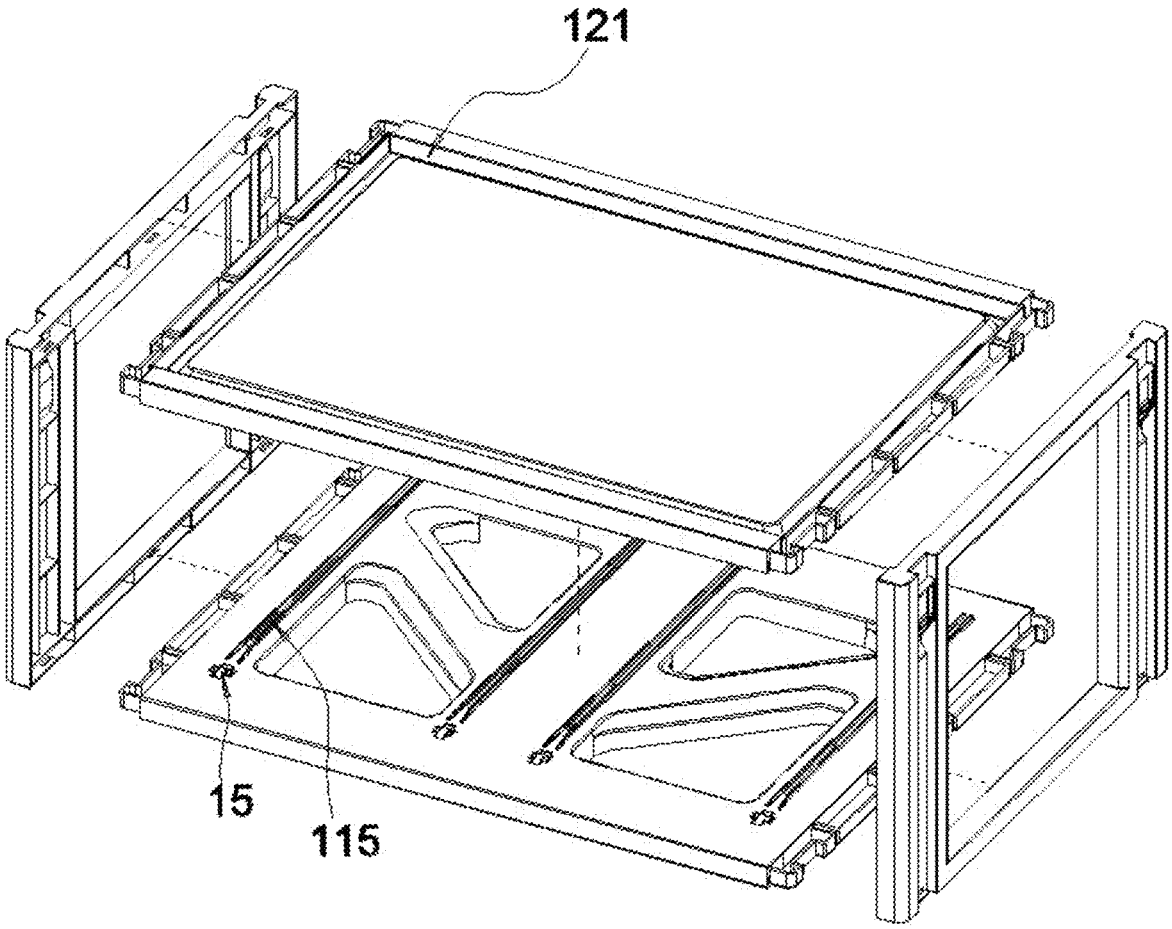
FIG. 17 is a schematic diagram showing rollers and slide rail grooves installed on the bottom plate of the frame.
Figure 18:
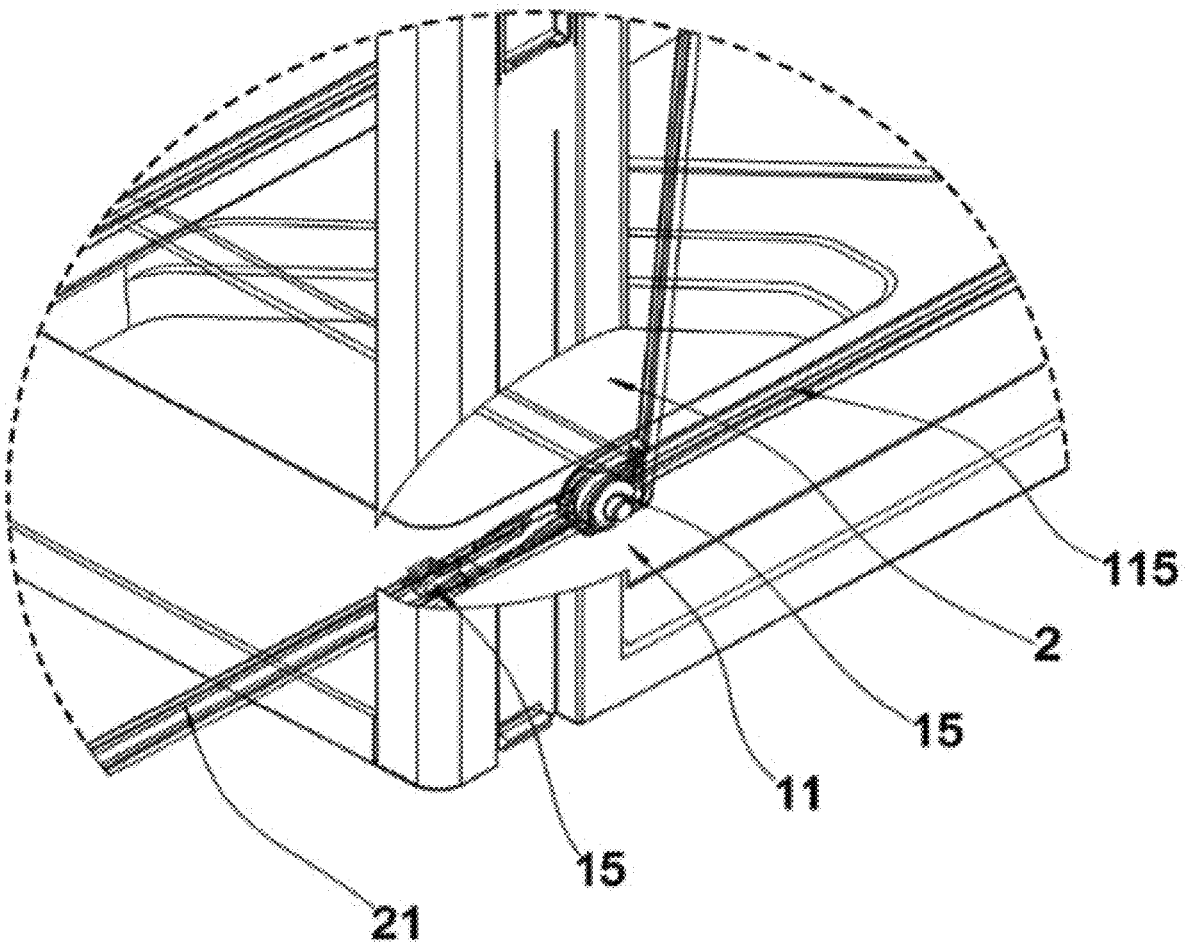
FIG. 18 is a partial cross-sectional view of the drawer when the drawer slides into the frame.

In one embodiment, as shown in FIG. 15, FIG. 17, and FIG. 18, multiple rollers 15 are correspondingly disposed on a top of the bottom plate 11 and the bottom of the drawer 2. Multiple concaves (not shown) are formed on the top of the bottom plate 11 and the bottom of the drawer 2. The rollers 15 are engaged in the concaves by snaps (not shown) and are restricted from rolling out. The multiple rollers 15 on the bottom plate 11 are each respectively located at one end of each of the multiple slide rail grooves 115 and are in contact with the bottom of the drawer 2, and the multiple rollers 15 at the bottom of the drawer 2 are in contact with the top of the bottom plate 11. Accordingly, the slide rail grooves 115, the slide bars 21, and the rollers 15 jointly form a slide rail system that limits the drawer 2 to smoothly and freely move in a line along a track of the slide rail groove 115 without ejecting from the frame 1, and the smooth operation is performed even when the drawer 2 is fully loaded.

The top of the bottom plate 11 of the frame 1 further has a first stopping protrusion 116 and a second stopping protrusion 117. The first stopping protrusion 116 is located near a drawer opening on the frame 1 and corresponds to one end of the slide rail groove 115 for cooperating with the slide bar 21 to prevent the drawer 2 from slipping out of the frame 1 through the drawer opening. The second stopping protrusion 117 is located away from the drawer opening on the frame 1 and corresponds to another end of the slide rail groove 115 for cooperating with the slide bar 21 to prevent the drawer 2 from slipping out of the frame 1 on the opposite side of the drawer opening.

In the present embodiment, the first stopping protrusion 116 and the second stopping protrusion 117 are specifically convex strips.

Figure 19:
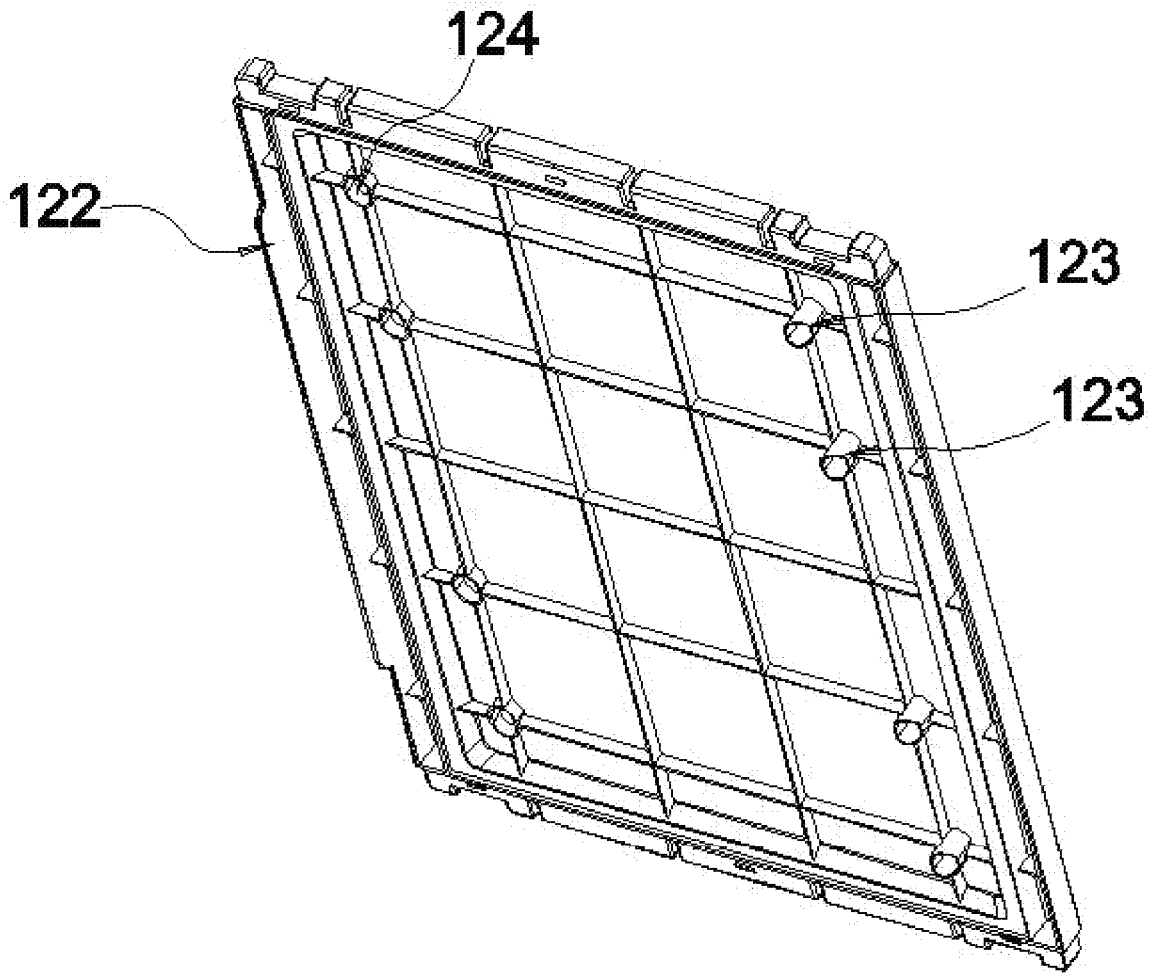
FIG. 19 is a schematic diagram of the top plate having stop ribs, stop posts, and limiting holes.
Figure 20:
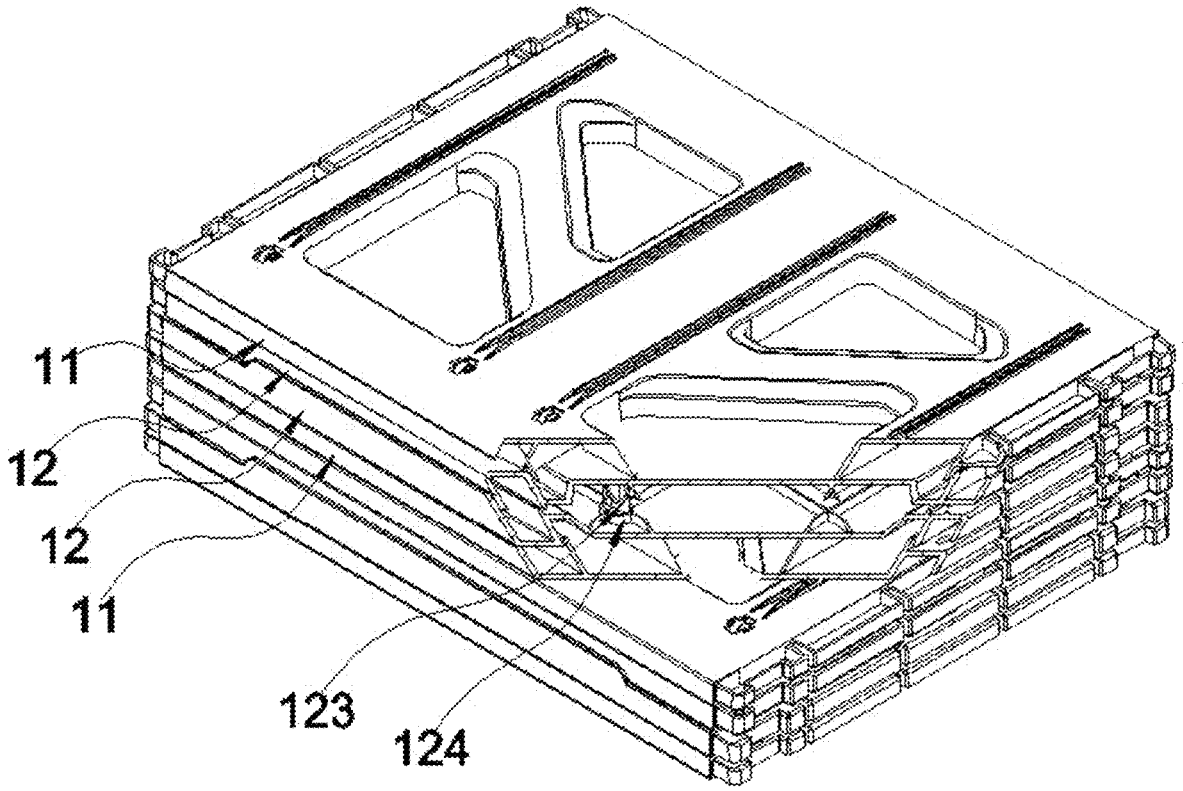
FIG. 20 is a perspective cross-sectional view of multiple top plates and bottom plates stacked.
Figure 21:
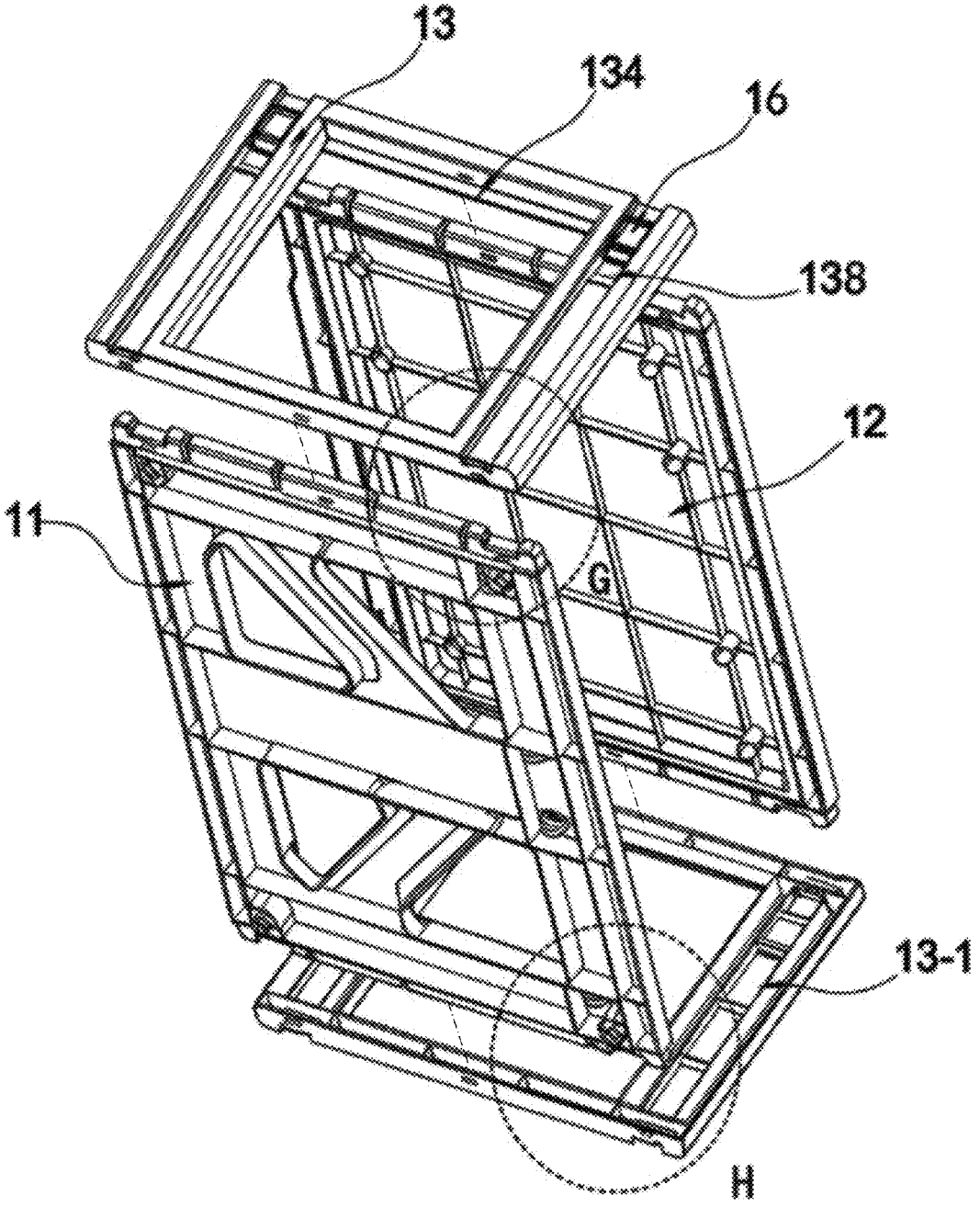
FIG. 21 is another exploded view of the frame of the storage box.
Figure 22:
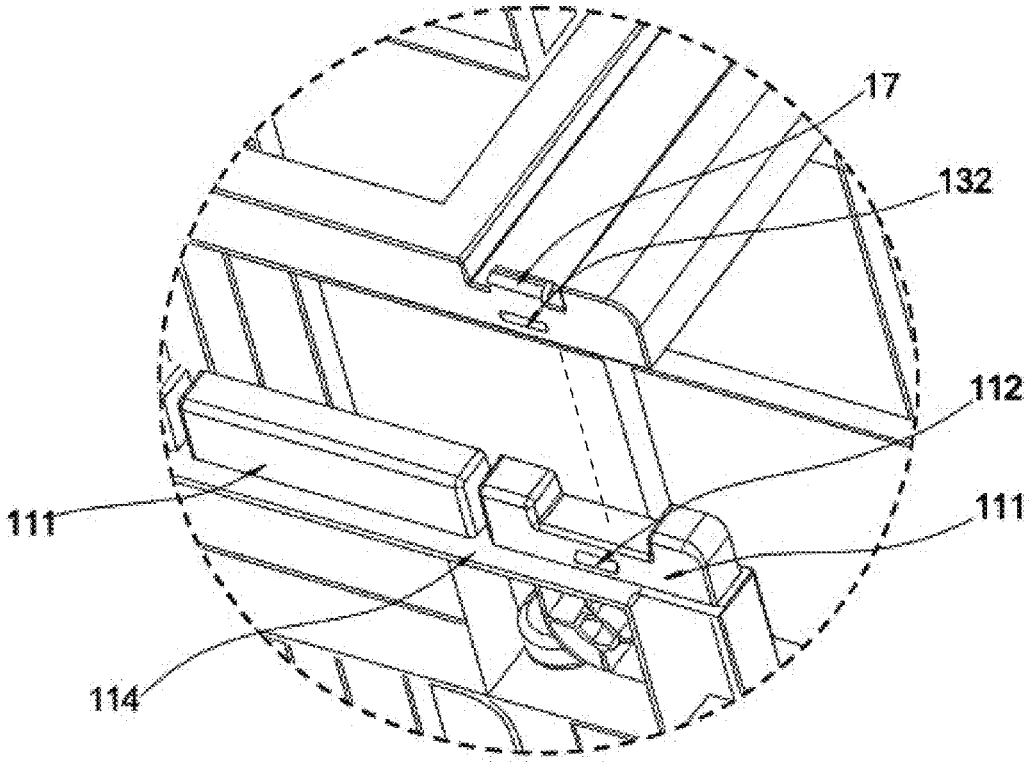
FIG. 22 is an enlarged view of part G of FIG. 21.

Furthermore, as shown in FIG. 19 and FIG. 20, one end of the top plate 12 has a stop post 123 for limiting the drawer 2 from detaching from the frame 1, the stop post 123 has an arc-shaped opening, and the arc-shaped opening of the stop post 123 facilitates a smooth installation of the drawer 2 into the frame 1 via an inclined movement. Another end of the top plate 12 has a stop rib 122 for limiting the drawer 2 from detaching from the frame 1.

Moreover, the top plate 12 has a limiting hole 124 formed to be opposite to the stop post 123. In a stacked state of multiple ones of the bottom plate 11 and the top plate 12, the top plate 12 is laid flat on the bottom plate 11, and the stop post 123 on the top plate 12 is embedded in the limiting hole 124 of another top plate 12. Specifically, the bottom plate 11 and the top plate 12 can be stacked. Since the top plate 12 has a protruded structure (the stop post 123) that prohibits direct stacking, a flipping can be performed for stacking. During stacking, the stop post 123 of the upper top plate 12 is inserted into a hole of the lower top plate 12, such that after stacking, a packaging volume is reduced and the movement of the components is limited.

In addition, each of a lateral side of the first bracket 13 and a lateral side of the second bracket 13-1 has a recess 138, and the recess 138 correspondingly passes through the first bracket 13 or the second bracket 13-1. A side buckle 16 is installed on an upper part inside of the recess 138, and a flange 17 is formed on a lower part inside of the recess 138. Two adjacent ones of the frame 1 are fastened together through the side buckle 16 and the flange 17. Accordingly, when two of the frames 1 are stacked, the side buckle 16 located at the lower frame 1 buckles upward, and a position for buckling is correspondingly located at the flange 17 at a bottom of the upper frame 1. That is, the side buckle 16 of the lower frame 1 is fastened with the flange 17 of the upper frame 1. When the drawer 2 that the upper frame 1 belongs to is fully loaded and drawn out to an outermost position, the locking effect of the side buckle 16 prevents the drawer 2 to bring the frame 1 forward and fall. In addition, the recess 138 on the lateral side of the first bracket 13 ensures a certain extent of movement and operation space for a hand performing the action of locking the side buckle 16.

Figure 23:
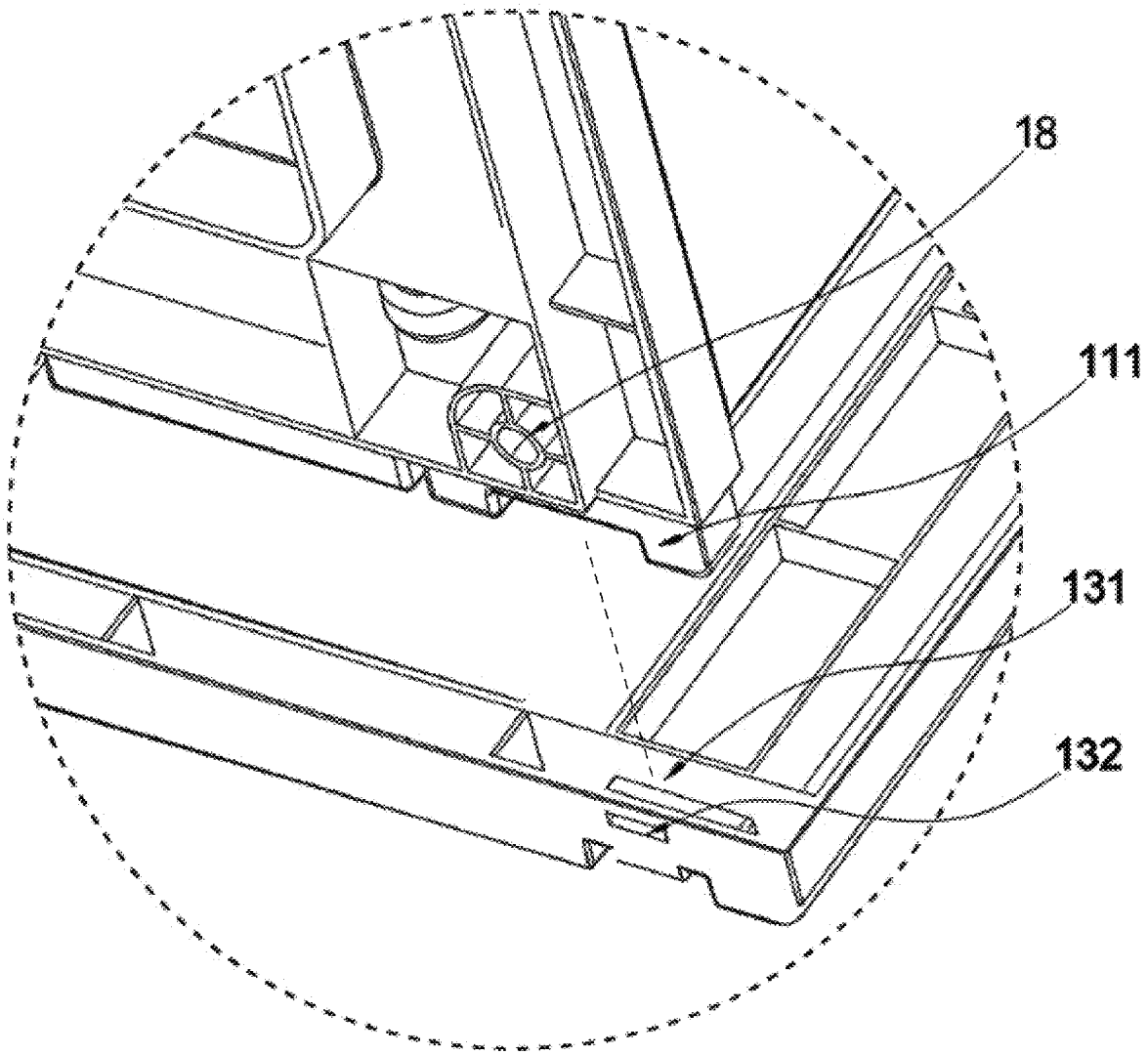
FIG. 23 is an enlarged view of part H of FIG. 21.

In the present embodiment, as shown in FIG. 23, the bottom of the bottom plate 11 has multiple universal wheel mounting holes 18. The forming of the universal wheel mounting holes 18 facilitates the install of the universal wheel at the bottom of the bottom plate 11, such that the frame 1 can be moved by sliding.

The foregoing is only intended to illustrate the technical solution of the present disclosure rather than to limit it. Other modifications or equivalent replacements made to the technical solution of the present disclosure by those skilled in the art shall fall within the scope of the claims of the present disclosure, as long as they do not depart from the spirit and scope of the technical solution of the present disclosure.

What is claimed is:

1. A storage box with a drawer, comprising:

a frame (1); and a drawer (2) slidably disposed within the frame (1);

wherein a bottom of the frame (1) has a joining portion, a top of the frame (1) has a joined portion, and the frame (1) includes:

a first bracket (13) and a second bracket (13-1) opposite to each other; and a top plate (12) and a bottom plate (11) detachably disposed between the first bracket (13) and the second bracket (13-1);

wherein each of opposite sides of the first bracket (13) and the second bracket (13-1) has a connecting groove (131), and a side of the connecting groove (131) has a clamping hole (132); wherein each of an end portion of the top plate (12) and an end portion of the bottom plate (11) has a tongue plate (111), and a side of each of the tongue plates (111) has an engaging block (112); and wherein the tongue plate (111) is inserted into the connecting groove (131), and the engaging block (112) is engaged to the clamping hole (132);

wherein each of the first bracket (13) and the second bracket (13-1) is a quadrilateral bracket, the quadrilateral bracket includes a horizontal beam and a vertical beam, and the connecting groove (131) is arranged on the horizontal beam;

wherein multiple connecting grooves (131) are provided, each of the connecting grooves (131) is arranged at intervals along an extension direction of the horizontal beam, and the tongue plates (111) correspond to the connecting grooves (131), respectively;

wherein end portions of the top plate (12) and the bottom plate (11) respectively have mounting positioning portions (113), and the vertical beam has positioning matching portions (136) corresponding to the mounting positioning portions (113), and during installation, the mounting positioning portions (113) enter the positioning matching portions (136) earlier than the tongue plates (111) enter the connecting grooves (131).

2. The storage box with the drawer according to claim 1, wherein the joining portion has a plug-in portion (133) provided on a bottom of the vertical beam, and an enclosure plate (114) provided on a bottom of the bottom plate (11); and wherein the joined portion has a plug-in fitting portion (134) provided on a top of the vertical beam, and a positioning cavity (121) provided on a top of the top plate (12) and corresponding to the enclosure plate (114).

3. The storage box with the drawer according to claim 2, wherein the bottom plate (11) has a hollow hole (118); the joining portion further includes a friction plate (119) that extends downward from an edge of the hollow hole (118), and the friction plate (119) is configured so that when multiple said storage boxes are stacked, the friction plate (119) frictionally engages with the top of the top plate (12) of an adjacent one of the multiple storage boxes.

4. A storage box with a drawer, comprising:

a frame (1); and a drawer (2) slidably disposed within the frame (1);

wherein a bottom of the frame (1) has a joining portion, a top of the frame (1) has a joined portion, and the frame (1) includes:

a first bracket (13) and a second bracket (13-1) opposite to each other; and a top plate (12) and a bottom plate (11) detachably disposed between the first bracket (13) and the second bracket (13-1);

wherein lateral sides of the drawer (2) are inclined downward and inward; and the drawer (2) has four corner portions, each of the corner portions has a lateral recess (22) facing outward, the lateral recess (22) has a supporting eave (26) arranged on an outer side of the corner portions, and the lateral recess (22) has a rib (23) that extends vertically;

wherein the supporting eaves (26) are configured so that: when multiple said drawers (2) are nested, the supporting eaves (26) have a supporting fit with edges of an opening of an adjacent one of the multiple drawers (2) to provide support for the multiple drawers (2) in a direction of gravity;

wherein the ribs (23) are configured so that: when the multiple drawers (2) are nested, the ribs (23) have an abutment fit with outer walls of the lateral recesses (22) of the adjacent one of the multiple drawers (2) to provide support for the adjacent one of the multiple drawers (2) in a horizontal direction, and a gap is provided between adjacent walls of the adjacent drawers (2) to avoid friction between the adjacent walls.

5. The storage box with the drawer according to claim 4, wherein a distance between the supporting eave (26) and the opening of the drawer (2) is not less than a thickness of the first bracket (13), and is not less than a thickness of the second bracket (13-1); wherein a minimum length of the drawer (2) is greater than a length of the first bracket (13), a minimum width of the drawer (2) is greater than a height of the first bracket (13), and the second bracket (13-1) is equal in length and height to the first bracket (13); and the rib (23) does not protrude from an inner surface of a corresponding one of the corner portions.

6. The storage box with the drawer according to claim 4, wherein each of the first bracket (13) and the second bracket (13-1) is a quadrilateral bracket, the quadrilateral bracket includes a horizontal beam and a vertical beam, and the connecting groove (131) is arranged on the horizontal beam;

wherein the joining portion has a plug-in portion (133) provided on a bottom of the vertical beam, and an enclosure plate (114) disposed at a bottom of the bottom plate (11); and the joined portion has a plug-in fitting portion (134) provided on the bottom of the vertical beam, and a positioning cavity (121) provided on a top of the top plate (12) and corresponding to the enclosure plate (114).

7. The storage box with the drawer according to claim 6, wherein the bottom plate (11) has a hollow hole (118); the joining portion further includes a friction plate (119) extending downward from an edge of the hollow hole (118), and the friction plate (119) is configured so that when multiple said storage boxes are stacked, the friction plate (119) frictionally engages with the top of the top plate (12) of the adjacent one of the multiple storage boxes.

8. The storage box with the drawer according to claim 4, wherein each of a lateral side of the first bracket (13) and a lateral side of the second bracket (13-1) is provided with a recess (138), and the recess (138) correspondingly passes through the first bracket (13) or the second bracket (13-1); wherein a side buckle (16) is installed on an upper part inside of the recess (138), and a flange (17) is provided on a lower part inside of the recess (138); and wherein two adjacent ones of the frame (1) are fastened together through the side buckle (16) and the flange (17).

9. The storage box with the drawer according to claim 4, wherein a top of the bottom plate (11) has multiple slide rail grooves (115), and the multiple slide rail grooves (115) are parallel to each other; and multiple slide bars (21) equal in quantity to the multiple slide rail grooves (115) are disposed on a bottom of the drawer (2), and the multiple slide bars (21) are embedded in the multiple slide rail grooves (115).

10. The storage box with the drawer according to claim 9, wherein multiple rollers (15) are correspondingly disposed on the top of the bottom plate (11) and the bottom of the drawer (2), the multiple rollers (15) on the bottom plate (11) are each respectively located at one end of each of the multiple slide rail grooves (115) and are in contact with the bottom of the drawer (2), and the multiple rollers (15) at the bottom of the drawer (2) are in contact with the top of the bottom plate (11).

11. The storage box with the drawer according to claim 4, wherein one end of the top plate (12) has a stop post (123) for limiting the drawer (2) from detaching from the frame (1), the stop post (123) has an arc-shaped opening, and another end of the top plate (12) has a stop rib (122) for limiting the drawer (2) from detaching from the frame (1).

12. The storage box with the drawer according to claim 11, wherein the top plate (12) has a limiting hole (124) formed to be opposite to the stop post (123); and in a stacked state of multiple ones of the bottom plate (11) and the top plate (12), the top plate (12) is laid flat on the bottom plate (11), and the stop post (123) on the top plate (12) is embedded in the limiting hole (124) of another top plate (12).

13. The storage box with the drawer according to claim 4, wherein at least one step post (27) that is outwardly protruding is provided on an upper lateral side of the drawer (2), and, when two of the drawers (2) are stacked, an edge of an upper one of the two drawers (2) is abutted against a lower edge of the step post (27) of a lower one of the two drawers (2).

14. The storage box with the drawer according to claim 4, wherein a bottom of the bottom plate (11) has multiple universal wheel mounting holes (18).

* * * * *